US006282819B1

(12) United States Patent
Gu

(10) Patent No.: US 6,282,819 B1
(45) Date of Patent: Sep. 4, 2001

(54) DESIGN AND MANUFACTURE OF COMMUNICATING CARD

(75) Inventor: Jing Lu Gu, 1620 Oakland Rd., Ste. D 202, San Jose, CA (US) 95131

(73) Assignee: Jing Lu Gu, Milpitas, CA (US)

( * ) Notice: Subject to any disclaimer, the term of this patent is extended or adjusted under 35 U.S.C. 154(b) by 0 days.

(21) Appl. No.: 08/661,110

(22) Filed: Jun. 10, 1996

(51) Int. Cl.[7] ..... G09F 1/00

(52) U.S. Cl. ..... 40/124.03; 40/124.191; 40/717; 40/455; 40/124.06

(58) Field of Search ..... 40/124.03, 124.06, 40/124.191, 717, 455; 273/237; 340/384.1, 384.6, 384.7; 361/737, 752, 796

(56) References Cited

U.S. PATENT DOCUMENTS

| | | | | |
|---|---|---|---|---|
| 3,691,312 | | 9/1972 | Petersen . | |
| 3,798,806 | | 3/1974 | Sanford . | |
| 3,857,191 | | 12/1974 | Sadorus . | |
| 4,302,752 | * | 11/1981 | Weitzler | 340/309.15 |
| 4,531,310 | | 7/1985 | Acson et al. . | |
| 4,607,747 | | 8/1986 | Steiner . | |
| 4,703,573 | | 11/1987 | Montgomery et al. . | |
| 4,791,741 | * | 12/1988 | Kondo | 40/455 X |
| 4,866,865 | * | 9/1989 | Yang | 40/455 |
| 4,934,079 | | 6/1990 | Hoshi . | |
| 5,010,665 | | 4/1991 | Clinkscales . | |
| 5,030,485 | | 7/1991 | Meets et al. . | |
| 5,063,698 | | 11/1991 | Johnson et al. . | |
| 5,182,872 | | 2/1993 | Lee et al. . | |
| 5,275,285 | | 1/1994 | Clegg . | |
| 5,433,035 | * | 7/1995 | Bauer | 40/124.03 |
| 5,480,156 | | 1/1996 | Doederlein et al. . | |
| 5,499,465 | * | 3/1996 | Manico | 40/717 |
| 5,530,626 | * | 6/1996 | Norment | 361/814 |
| 5,641,164 | * | 6/1997 | Doederlein et al. | 40/455 X |
| 5,671,555 | * | 9/1997 | Fernandes | 40/124.03 |
| 5,855,001 | * | 12/1998 | Doederlein et al. | 40/455 X |
| 6,072,980 | * | 6/2000 | Manico et al. | 434/317 |

* cited by examiner

*Primary Examiner*—Terry Lee Melius
*Assistant Examiner*—James M Hewitt
(74) *Attorney, Agent, or Firm*—Peninsula Law Group; Daniel Hopen

(57) ABSTRACT

Designs and manufacturing methods provide flexibility in the manufacture and assembly of the communicating card of this invention. The communicating card includes a housing into which an electronic module is inserted. The housing is configured so that it can be manufactured independently of the electronic module. The electronic module is constructed to allow programming of the communication after the module has been manufactured, before or after insertion into the housing.

23 Claims, 28 Drawing Sheets

DESIGN AND MANUFACTURE OF COMMUNICATING CARD

TECHNICAL FIELD

The present invention relates to communicating cards which deliver a communication upon actuation and, more particularly, to improved construction and manufacturing techniques for economically producing such communicating cards.

BACKGROUND OF THE INVENTION

Communicating cards have become well known over the past several years in conjunction with advances made in microelectronics and integrated circuit designs. A communicating card delivers a communication in response to an actuation signal. Talking greeting or trading cards are the most common embodiment of communicating cards, delivering audible communications, although cards which deliver other communications, including visual, tactile or wireless (e.g., RF) communications, are within the scope of the teachings of the present invention. Combinations of communication types, such as audible and visual, are also within the scope of the teachings of the present invention. A communicating card is typically small and thin, such as the size of trading cards, business cards, and the like, but may also be of other sizes and shapes.

The deficiencies with current communicating cards are exemplified by the designs of and manufacturing methods used for currently available talking greeting or trading cards. With current cards, it is known to assemble the portion carrying the electronics, record the message and adhere the preprinted card covering onto the frame carrying the electronics. Such prior art designs and manufacturing methods require that essentially all manufacturing/assembling steps be taken sequentially, without the capability of taking some steps in parallel to reduce the total time.

These designs and associated manufacturing methods limit the ability to maintain a flexible supply of inventory which can be easily adapted to demand for particular types of cards, particular graphical/written indicia on the card and particular prerecorded or preprogrammed communication. For example, once a card covering is adhered to the electronics portion, the communication cannot be easily changed. Neither can the covering, which has been preprinted, be changed. If, after completion of the card, it becomes desirable to change the communication or the covering, it cannot be easily done, if at all. This creates an inflexible inventory situation in which the communication and covering are susceptible to being outdated or unneeded. The alternative, using such prior art designs and manufacturing methods, is to complete the cards as needed, in a just-in-time manner. In instances where the demand for the cards is cyclical or seasonal in nature, such an alternative may not be timely enough to meet the needs.

These designs and manufacturing methods are also not well suited for high volume, mass production of communication cards. If high speed equipment is used, there is the potential for damage to the electronics during adherence of the cover to the electronics portion. Additionally, if, as is not unusual, the component which actuates the delivery of the communication includes a push button which extends from the surface of the card, there can be problems with registration between the opening in the card cover and the push button in high speed manufacturing. The solution to these problems has typically been to rely on hand work rather than high speed equipment, sacrificing efficiency, volume and economy to fit the available designs and manufacturing methods. In addition to the volume constraints presented by current designs and manufacturing methods, small volumes of cards are prohibitively expensive.

When the communication being delivered is an audible signal, typical prior art communicating cards do not deliver adequate sound volume and quality. These prior art designs lack sufficient acoustical coupling between the speaker and the outside of the card. Although the outer surface of such cards can be adapted for better sound transmissivity, such adaptations can add cost to the card and require registration between the outer surface and the speaker.

Thus, there is a need in the art for a design and manufacturing method with which communicating cards can be economically mass produced without posing risk of damage to the electronic components while providing flexibility in maintaining inventory stock. There is a need which allows the economic manufacture of cards with a variety of communications and coverings in large volumes as well as small volumes. There is a need for design and manufacturing methods which utilizes a high number of common elements/manufacturing steps which are independent of the communication or covering, thereby allowing most of the communication card to be constructed, yet leaving for last the steps which are unique to a particular communication and covering. There is a need for a design which provides better sound transmission.

SUMMARY OF THE INVENTION

It is an object of this invention to obviate the above-described problems in shortcomings of the prior art heretofore available.

It is another object of the present invention to provide improved techniques for the manufacture of communicating cards.

It is yet another object of the present invention to provide a design and manufacturing methods which are applicable to a wide variety of communicating cards.

It is another object of the present invention to provide a design and manufacturing methods which allow communication cards to be easily and economically mass produced.

It is yet a further object of the present invention to provide a communicating card which is very thin.

It is still a further object of the present invention to provide a design and manufacturing methods which allow communication cards to be manufactured as independent elements which can be manufactured in parallel, each other, prior to final assembly.

It is yet a further object of the present invention to provide a communication card which can be easily used or configured for a wide variety of applications.

It is another object of the present invention to provide a communication card, which, when configured to deliver an audible communication, has improved volume and quality.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided a communicating card which includes an electronic module with electronic circuitry, a communication interface coupled to the electronic circuitry and configured to deliver a communication through the communication interface in response to actuation and a housing having an internal cavity which is configured to receive the electronic module. The internal cavity includes an external opening through which the electronic module may be inserted into the internal cavity.

In accordance with another aspect of the present invention, the communication interface is a piezoelectric speaker.

In accordance with yet another aspect of the present invention, the speaker includes a foam support.

In accordance with still another aspect of the present invention, the electronic module includes a first layer and a second layer disposed adjacent each other, with the first layer carrying electronic components, and the second layer including a plurality of openings into which the electronic components extend.

In accordance with yet another aspect of the present invention, the electronic circuitry includes a programmable memory configured to be programmed with a communication for delivery through the communication interface.

In accordance with still another aspect of the present invention, the electronic module is withdrawable from the internal cavity a sufficient distance to provide access to at least one electrical contact whereby said programmable memory can be programmed.

In accordance with a further aspect of the present invention, the electronic circuitry includes a masked ROM.

In accordance with another aspect of the present invention, an actuation switch is provided. The switch may be carried by the electronic module.

In accordance with still another aspect of the present invention, the switch comprises a flexible, electrically conductive member disposed adjacent contacts. In accordance with yet another aspect of the present invention, the electronic module includes a first layer and a second layer, and the switch comprises first and second electrically conductive contacts respectively disposed thereon in a spaced apart relationship.

In accordance with another aspect of the present invention, there is provided a resilient detent interengaged between the electronic module and the housing so that said electronic module can be inserted into said housing with resilient deflection of the detent, and the electronic module can be withdrawn from said housing only a predetermined distance which is limited by engagement of the detent.

In accordance with yet another aspect of the present invention, the housing comprises a top sheet and a bottom sheet adhered to a center sheet.

In accordance with a further aspect of the present invention, a method of manufacturing a communicating card is provided, comprising the steps of providing a center sheet having a cavity formed therein, adhering a top sheet and a bottom sheet to the center sheet so as to form a housing having an internal cavity, providing an external opening to the internal cavity, providing an electronic module including electronic circuitry, providing a communication interface to be coupled to the electronic circuitry which is configured to deliver a communication through the communication interface in response to actuation of the electronic circuitry, and disposing the electronic module and the communication interface within the internal cavity.

In accordance with yet a further aspect of the present invention, a plurality of communicating cards are cut from a multi-layer construction which as a plurality of internal cavities formed therein.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
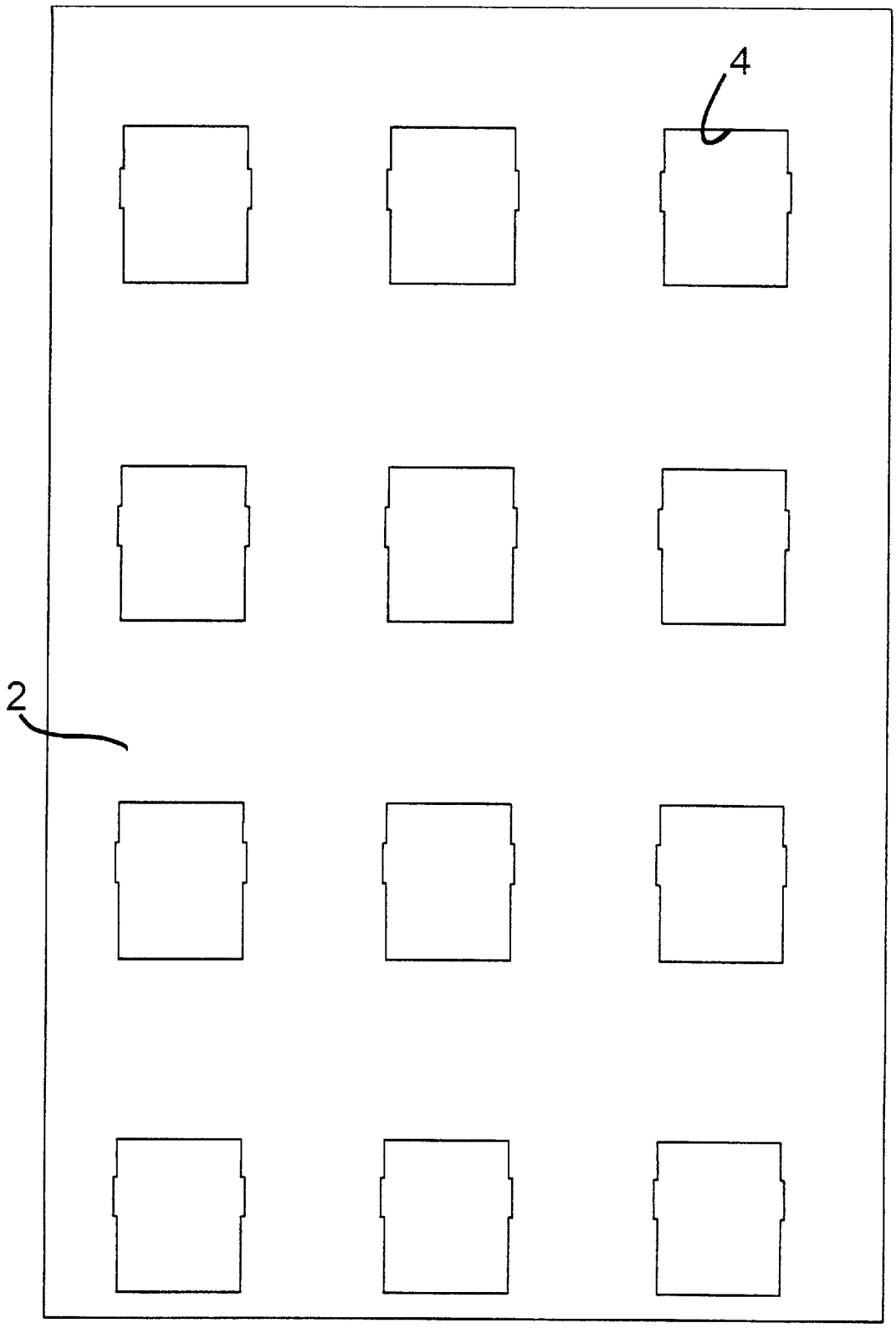
FIG. 1 is a top plan view of a large, flat, rectangular center sheet.

Referring to FIG. 1, the is shown a large, flat rectangular center sheet 2 which has a plurality of rectangular cavities 4 formed therein. Center sheet 2 is made from any suitable material of appropriate thickness. In the preferred embodiment, center sheet 2 is card stock of the type known as SBS paper or foamboard material. In the preferred embodiment, center sheet 2 is 0.085–0.135 inches thick. It will be understood, as mentioned, that other materials may be used if desired, including non-paper materials such as plastic. Other thicknesses may be used which are appropriate for the particular application.

For purposes of illustration, twelve cavities 4 are shown in FIG. 1. It is contemplated that center sheet 2 may be very large, and may contain many cavities 4. Cavities 4 are all essentially identical and generally rectangular, and may, for example, be on the order of 2" by 3". The contour may include other features as will be described hereinafter. In the preferred embodiment, cavities 4 are die cut. However, cavities 4 may be made by any other appropriate process, such as by punching, stamping, steel rule die cutting, sheer cutting, laser beam cutting, CNC numerical control automated machinery cutting, or the like.

Figure 2:
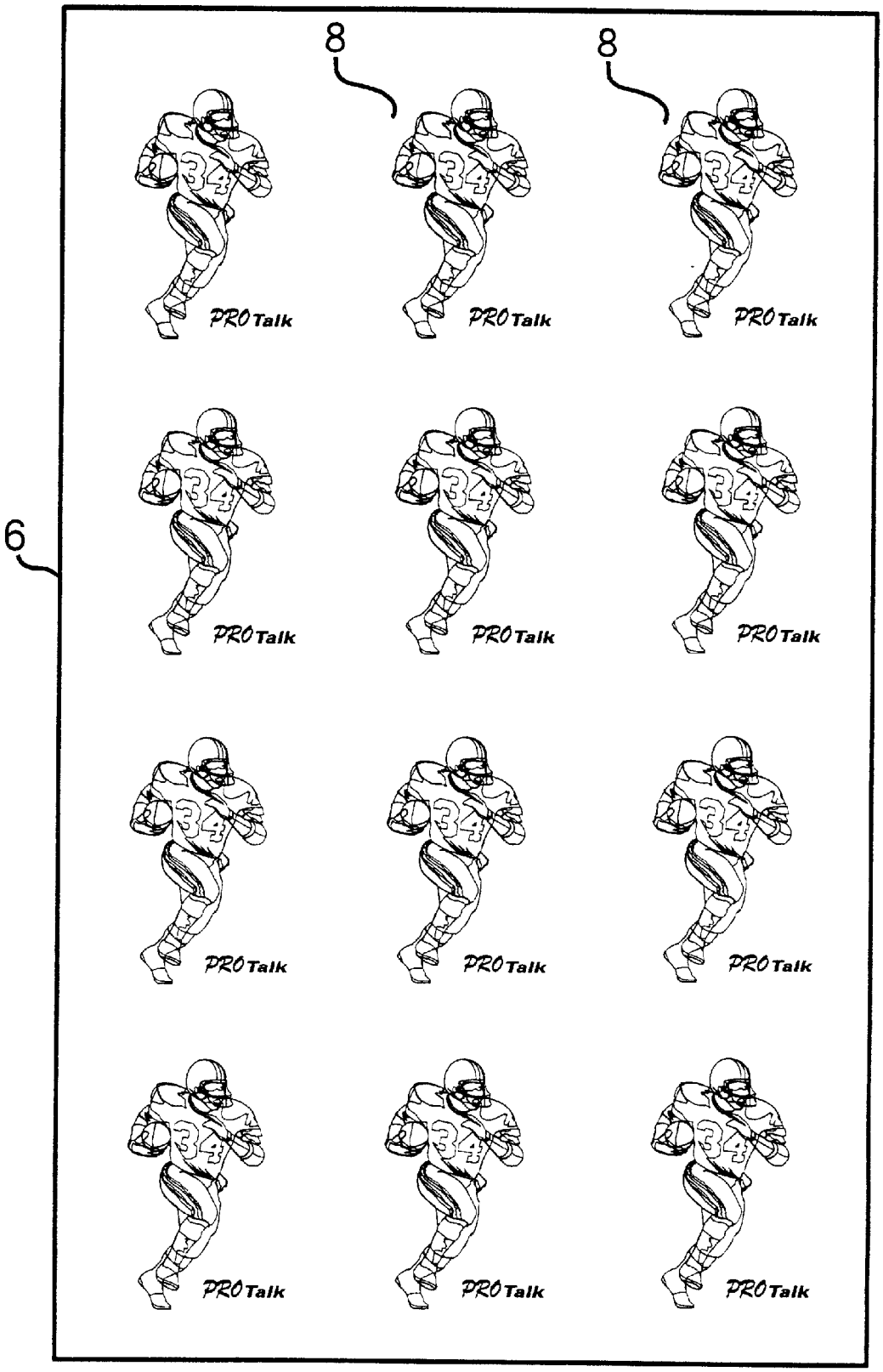
FIG. 2 is a top plan view of a large, generally flat, rectangular top sheet.

Referring to FIG. 2, there is shown a large, generally flat, rectangular top sheet 6. In the preferred embodiment, top sheet 6 is made of 12–18 point SBS paper. Top sheet 6 may be made of other materials and thicknesses as appropriate, and as will be explained hereinafter, may even made of plastic or metal, such as copper, steel or aluminum foil. In the preferred embodiment top sheet 6 is thinner than center sheet 2. The overall dimensions of top sheet 6 are generally complimentary to those of center sheet 2. However, the dimensions may vary as required for the particular embodiment, the production method or materials used.

Figure 8:
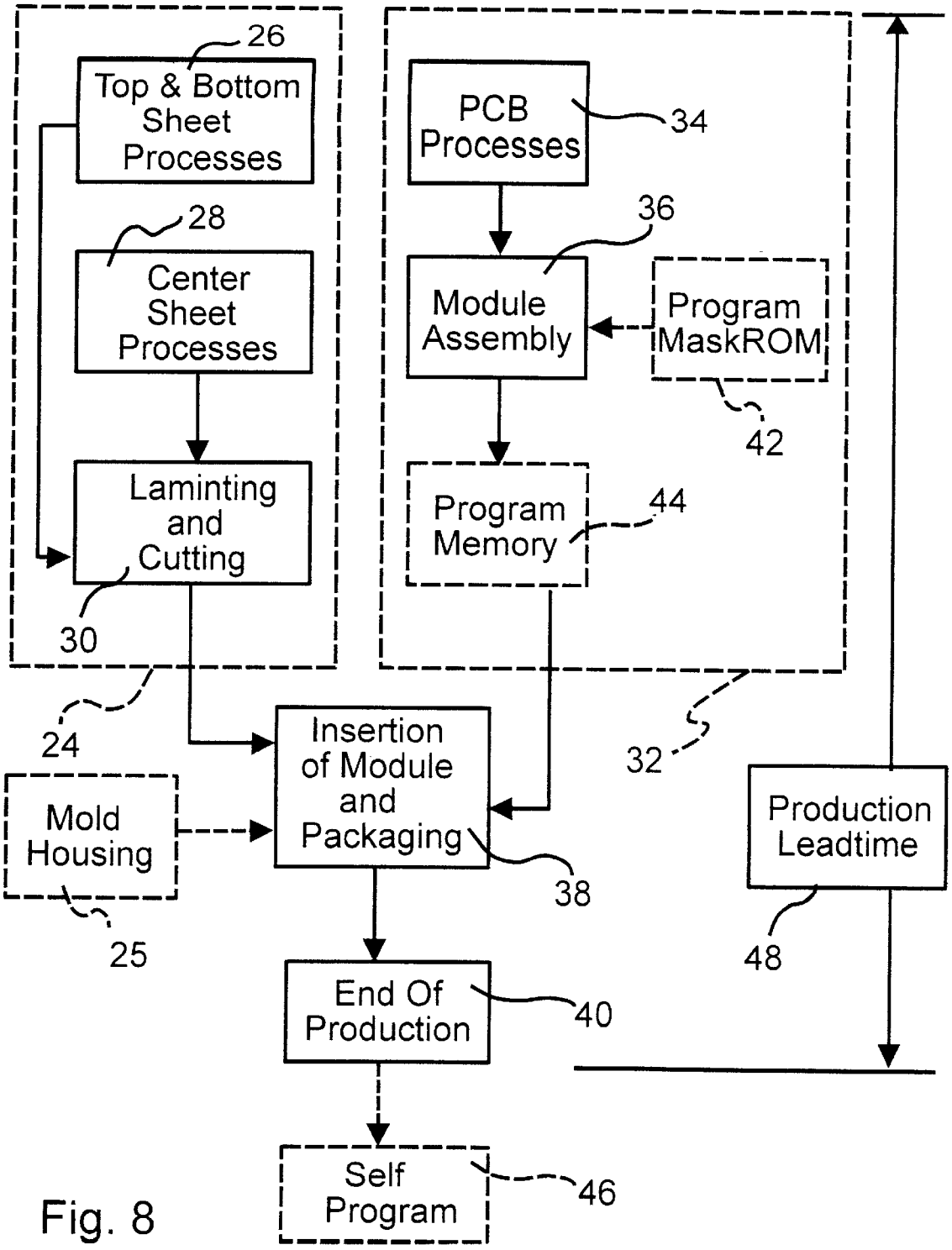
FIG. 8 is a flow chart showing a process for manufacturing communicating cards in accordance with the principals and teachings of the present invention.

As shown in FIG. 2, top sheet 6 has a plurality of identical graphical written indicia printed thereon, and this embodiment illustrated as football FIGS. 8, one for each cavity 4 formed in center sheet 2. It will be understood that this is by way of example only and, other graphical written indicia may be used.

Figure 3:
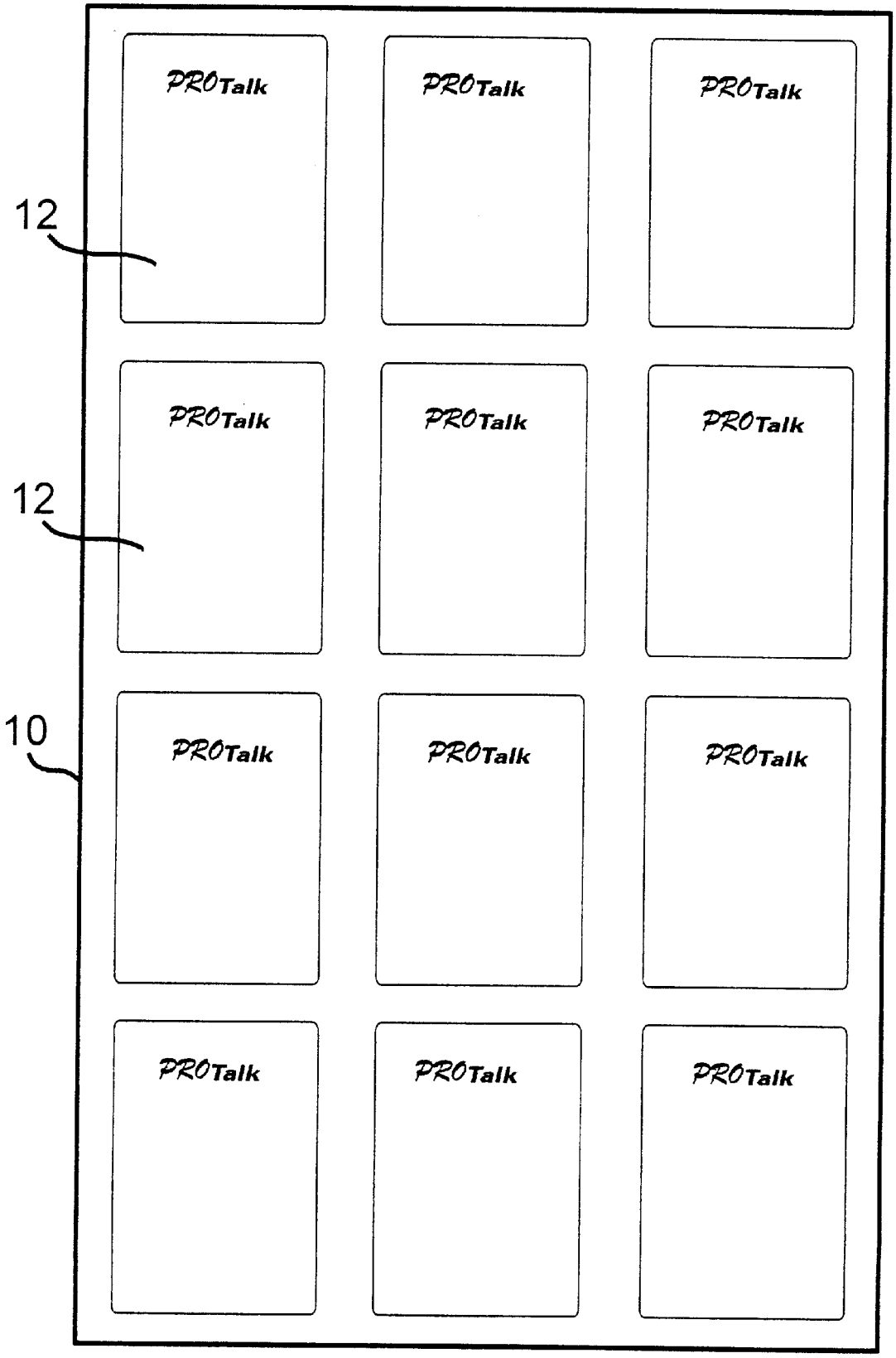
FIG. 3 is a top plan view of a large, generally flat, rectangular bottom sheet.

Referring to FIG. 3, there is shown large, generally flat, rectangular bottom sheet 10. In the preferred embodiment, bottom sheet 10 is made of 12–18 point SBS paper. Bottom sheet 10 may be made of other materials and thicknesses as appropriate, including plastic or metal, such as copper, steel or aluminum foil. In the preferred embodiment, bottom sheet 10 is thinner than center sheet 2. the overall dimensions of bottom sheet 10 are generally complimentary to those of center sheet 2. However, the dimensions may vary as required for the particular embodiment, the production method or materials used.

Referring to FIG. 3, bottom sheet 10 has a plurality of identical graphical/written indicia represented in FIG. 3 as football information blocks 12, one for each cavity 4. It will be understood that this is by way of example only, and as will be shown hereinafter, other graphical written indicia may be used.

Figure 4:
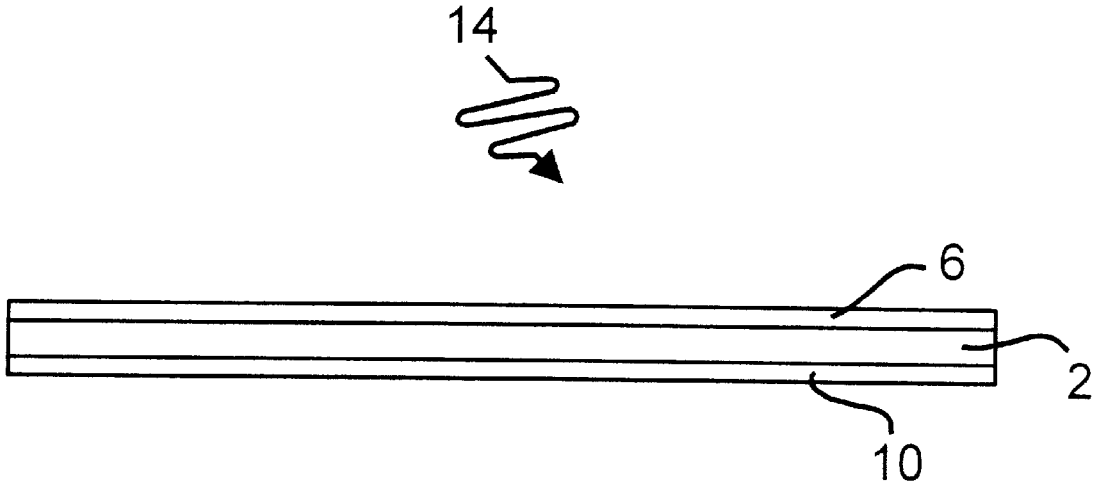
FIG. 4 is an enlarged side elevation view of a laminated composite sheet formed by adhering the top and bottom sheets of FIGS. 2 and 3 to the center sheet shown in FIG. 1.
Figure 5:
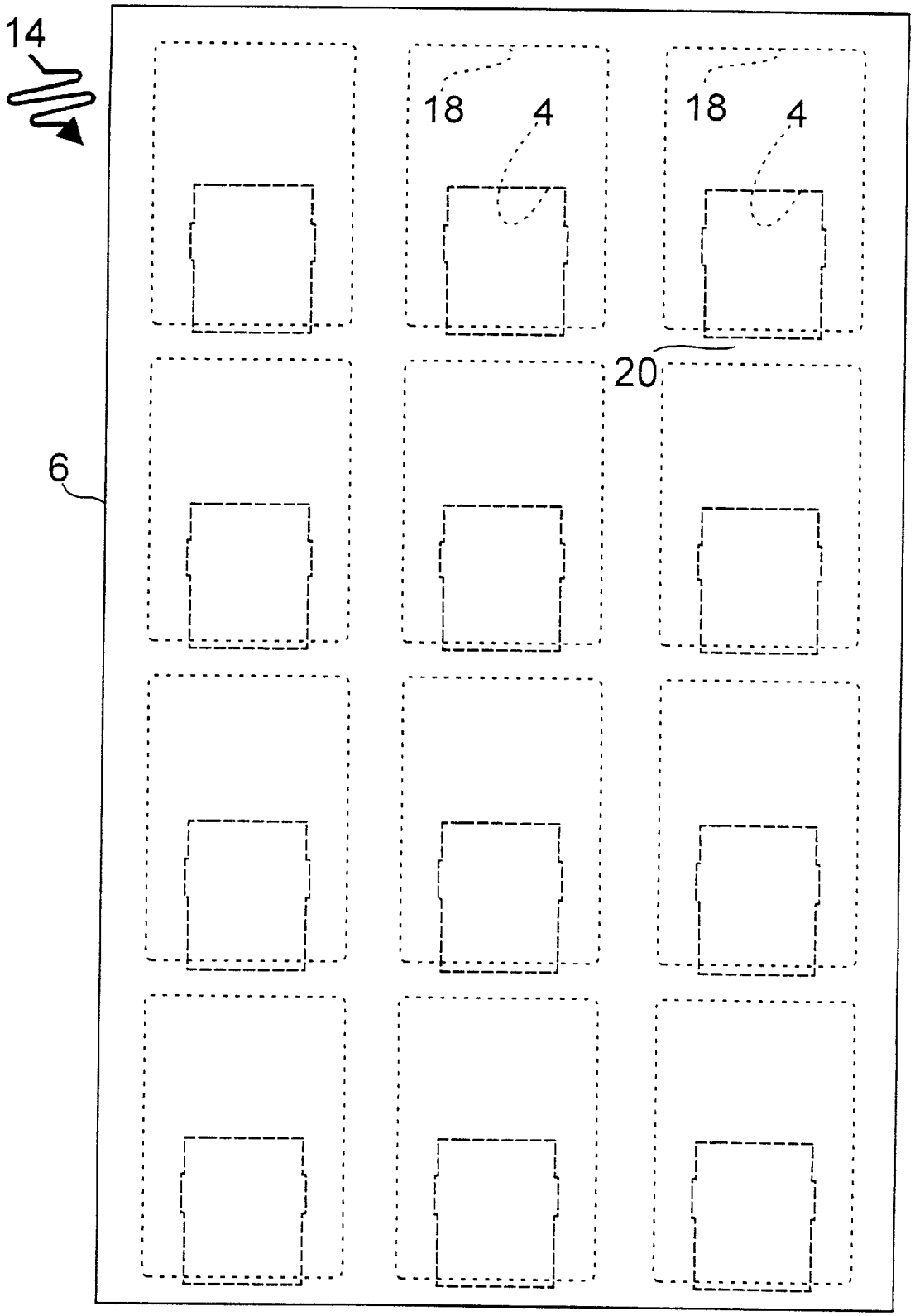
FIG. 5 is a top plan view of the laminated composite sheet of FIG. 4.
Figure 6:
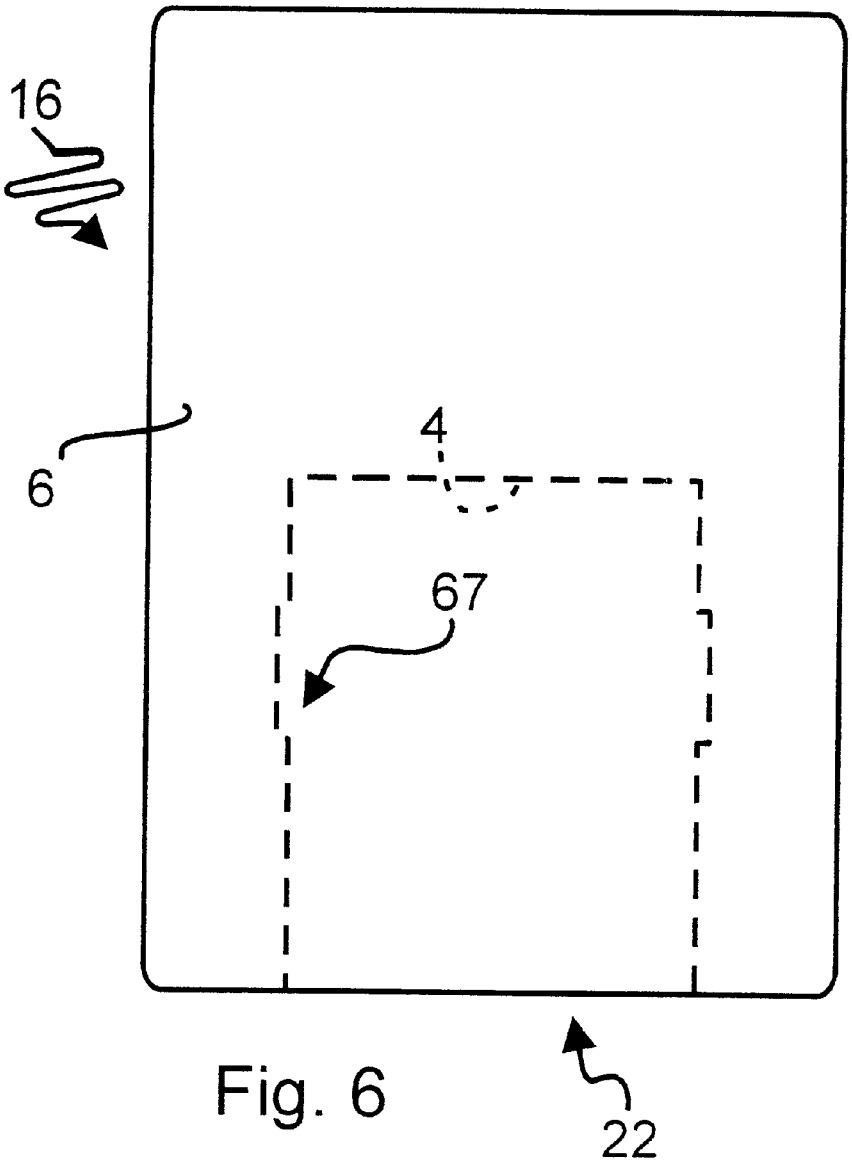
FIG. 6 is an enlarged top plan view of a individual communicating card housing, with the graphical/written indicia omitted for clarity.

FIG. 4 illustrates an enlarged side view of laminated composite sheet 14. The outer sheets, top sheet 6 and bottom sheet 10, have been adhered to opposite sides of center sheet 2, with the graphical/written indicia being appropriately aligned with cavities 4. Of course, the graphical/written indicia is facing out. Cavities 4 are covered by top sheet 6 and bottom sheet 10. Sheets 2, 6 and 10 may be adhered together by any means, such as by gluing, or even ultrasonic welding (in the case of plastic). Top sheet 6 and bottom sheet 10 may be coated to make them glossy and/or stronger. Referring now to FIG. 5, there is shown laminated composite sheet 14. However, for purposes of clarity, the graphical/written indicia printed on top sheet 6 has been omitted. The position of internal cavities 4, hidden by top sheet 6, is indicated by broken lines. FIG. 6 shows an individual communicating card housing 16 cut from composite sheet 14, without the graphical/written indicia printed thereon, omitted for clarity. In the preferred embodiment, a plurality of housings 16 are cut from composite sheet 14 in a single operation. As shown in FIG. 5, cuts 18 are indicated by phantom lines which outline the perimeter of housings 14. Cuts 18 intersect with cavities 4 in regions 20, respectively, resulting in cavities 4 being open at 22 so as to receive an electronic module, as will be described in more detail below. Cuts 18 are examples only. It is envisioned that various shapes and sizes, such as contoured shapes which match the graphical/written indicia (such as a photograph of a person) may be used. The size and shape of cavity 4 preferably remains the same regardless of the size and shape of the communicating card, providing standardization of the internal cavity.

Figure 7:
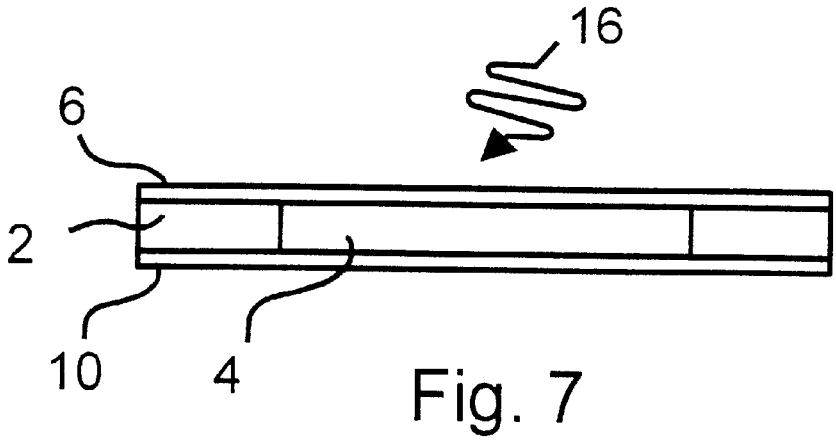
FIG. 7 is an enlarged end view of the housing shown in FIG. 6.

FIG. 7 is an end view of housing 16, showing internal cavity 4. It is anticipated that cuts 18 will be die cuts although other methods may be used. Although only twelve housings 16 are shown on composite sheet 14 in FIG. 5, it is contemplated that a large number of outer housing 16 could be made from a single composite sheet.

Referring now to FIG. 8, there is shown a process for manufacturing the communicating card in accordance with the teachings of the present invention. The two components of the communicating card, the electronic module and the housing are manufactured independently of each other, allowing for decrease of overall manufacturing time, and providing flexibility. In FIG. 8, there is shown box 24 which represents the method for manufacturing the housing. Box 26 represents the steps involved in creating and printing the graphical/written indicia on the top and bottom sheets. Box 28 represents the steps involved in forming the cavities in the center sheet. Box 30 represents the steps involved in laminating the top and bottom sheets to the center sheet to make the laminated composite sheet and cutting the housings therefrom. An alternate method for manufacturing the housing is represented by dashed box 25, in which the housing is molded from a curable resin, which could replace the process of box 28.

Box 32 of FIG. 8 represents the method for manufacturing the electronic voice chip module which is ultimately inserted into the housing to form the completed communicating card. Box 34 represents the steps involved in making a printed circuit board using conventional printed circuit board processes. Box 36 represents the steps involved in mounting and assembling the various electronic components on the printed circuit board to produce the completed electronic module.

The products (i.e., electronic module and housing) of the processes depicted in boxes 24 and 32 of FIG. 8 are united in box 38, which represents the steps of one time insertion of the electronic module in the internal cavity of the housing, thereby locking the electronic module in place and packaging the product if needed. Box 40 represents the end of the process.

At some point, a communication must be programmed into a memory of the electronic circuitry. It is noted that the programming may be done at various times in the process. The boxes representing these various steps are shown as dashed boxes. Box 42 represents the use of a masked ROM, which is coded by the IC manufacturer, prior to the electronic module assembly. Box 44 represents the use of memory which is programmed after assembly of the electronic module. It is noted that the programming may be made at any time after enough components are installed on the printed circuit board so as to allow the programming to be done. Box 46 represents self programmable memory which is performed by the user, such as with the universal messager, as described below.

Box 48 and its associated arrows represent the overall production time required. As FIG. 8 illustrates, many of the manufacturing steps may be done in parallel.

Figure 9:
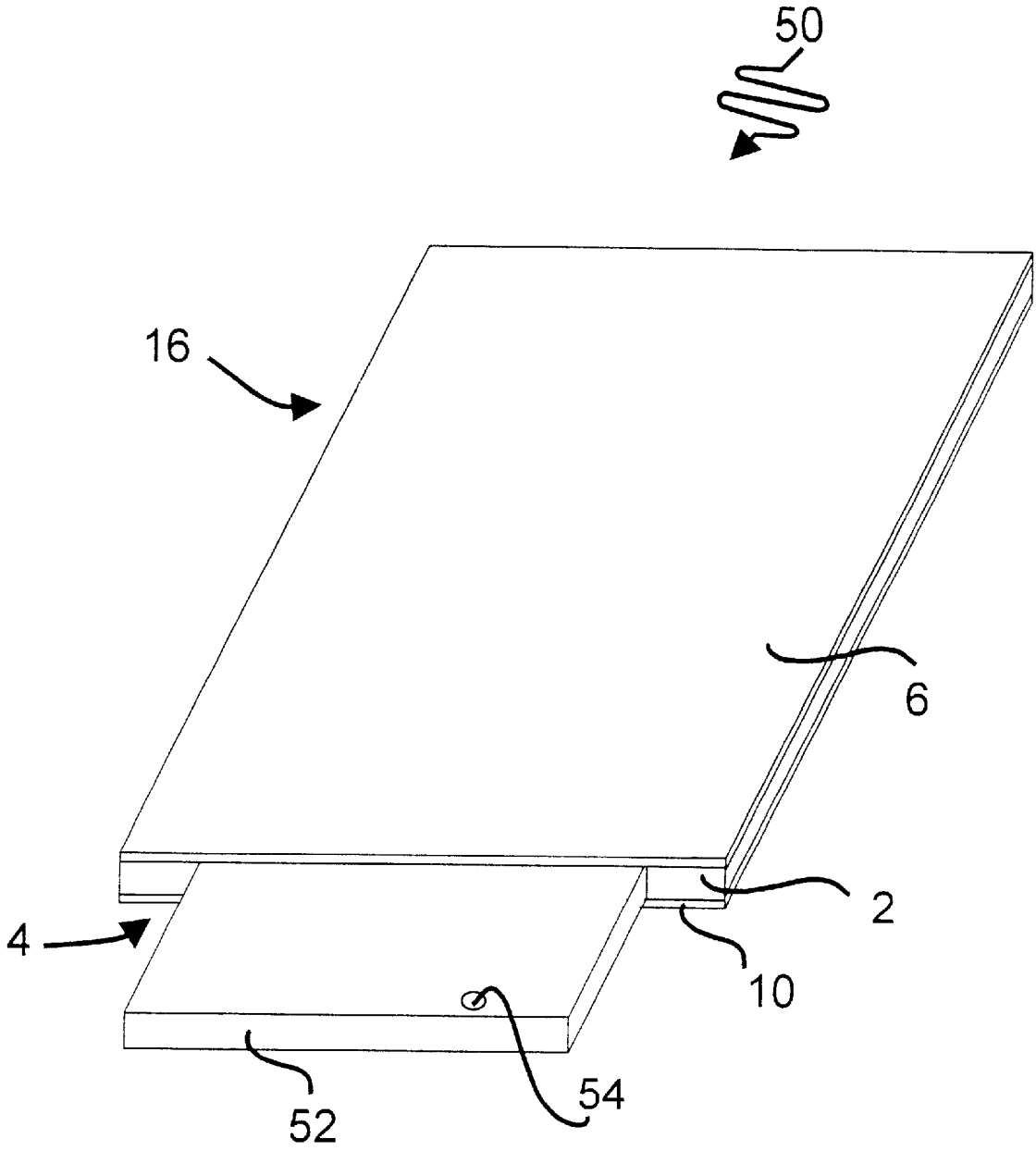
FIG. 9 is an enlarged perspective view of a communicating card constructed in accordance with the principals and teachings of the present invention.

FIG. 9 is a perspective view of a communicating card constructed in accordance with the principals and teachings of the present invention. Communicating card 50 comprises two separately manufactured components, housing 16 and electronic module 52. Electronic module 52 is disposed in cavity 4 of housing 16. In FIG. 9, electronic module 52 is shown partially inserted in cavity 4. Module 52 is approximately the same thickness as center sheet 2, and is complementarily sized to be received by cavity 4. By squeezing the sides of housing 16, the thin top and bottom sheets 6, 10 bow outwardly such that module 52 can be inserted into cavity 4. Module 52 has a smooth top and bottom, and slides smoothly into cavity 4, locking in place, as will be described below.

Although module 52 is locked into housing 16, it is a feature of the present invention that module 52 can slide out of housing 16 a limited distance for purposes that will be made clear hereinafter. Again, the sides of housing 16 are squeezed to allow module 52 to slide partially out of housing 16. In addition, small hole 54 may be provided near the outer edge of module 52 such that a small L-shaped tool similar to a bent paper clip may be inserted to assist the user in pulling out module 52. Access to hole 54 can be provided by the outward bowing of sheets 6 and 10, and optionally through an opening (not shown) in housing 16. Module 52 moves as if on a track for a limited range of travel.

Figure 10:
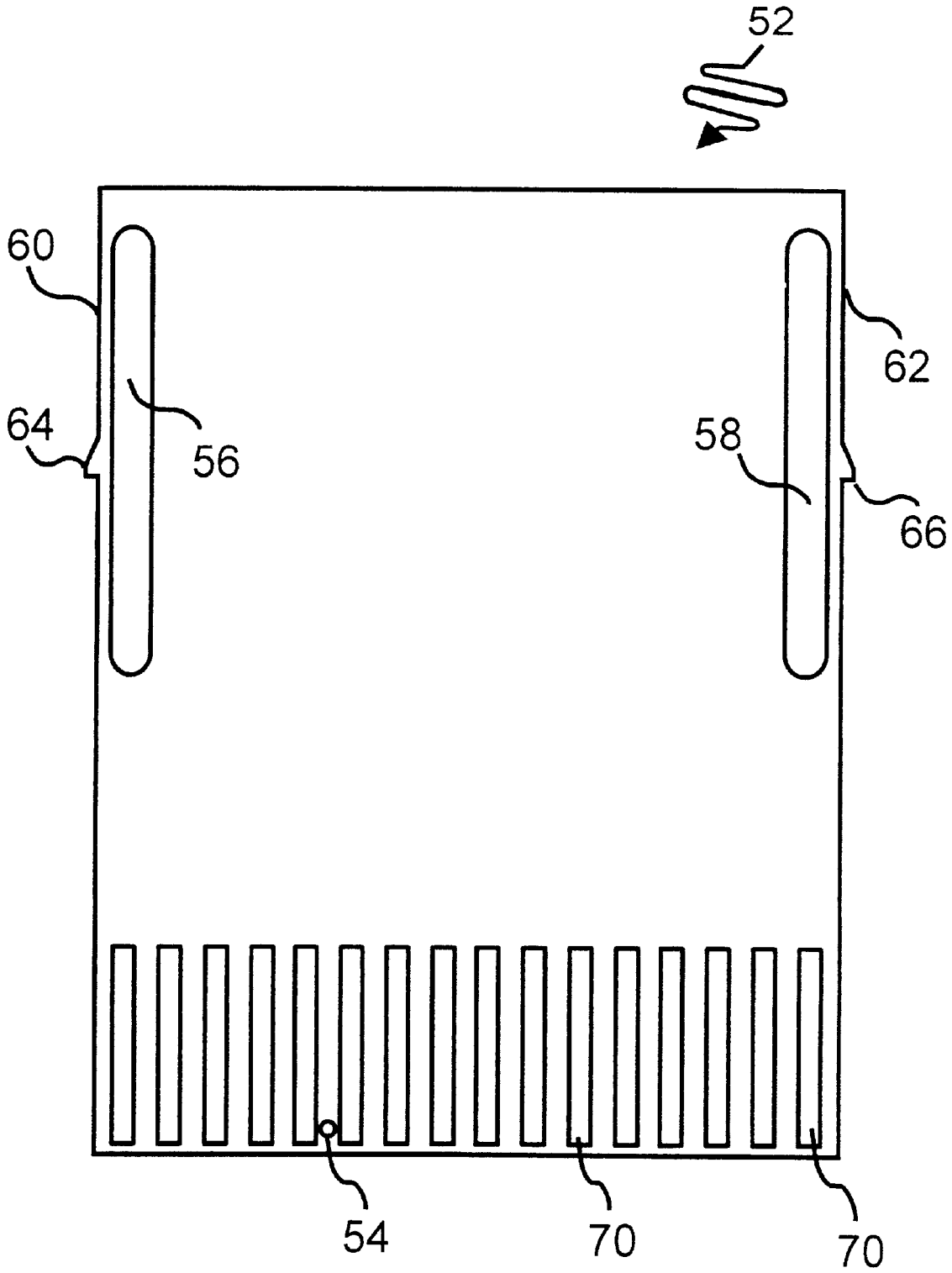
FIG. 10 is an enlarged bottom plan view of an electronic module constructed in accordance with the principals and teachings of the present invention.

FIG. 10 is an enlarged bottom, plan view of electronic module 52, showing its external outline and features which enable it to mate with housing 16. In one embodiment, module 52 is generally rectangular, and has a length and width on the order of 2 inches by 3 inches. Module 52 is constructed as disclosed hereinafter, and has a thickness to fit closely within cavity 4 but still allow module 52 to slide in and out. Movement of module 52 within its limited range of travel is resisted by the slight friction between module 52 and housing 16. Module 52 may be made of printed circuit board, having a thickness of approximately 0.085–0.135 inches. It will be recognized that these dimensions and materials are given by way of example only, and that other dimensions and materials may be employed.

Module 52 has two elongated slots, 56, 58 located adjacent the left and right edges and positioned near rear of the inner edge of module 52. Slots 56, 58 define thin webs 60, 62 at the side edges of module 52. Webs 60, 62 are resilient and act as spring-like flexures. Referring back to FIGS. 6 and 7, taken in conjunction with FIG. 10, when module 52 is inserted into cavity 4, detents 64, 66 slip into and engage elongated recesses 67. The flexibility and resilience of webs 60, 62 permit detents 64, 66 to flex inwardly when module 52 is inserted into cavity 4. Detents 64, 66 lock module 52 into cavity 4, and resisting, or preventing, full removal of module 52 from cavity 4. Detents 64, 66 are free to move back and forth within elongated recess 67 so that these elements define a tracking system that permits some movement of electronic module 52. Module 52 is provided with small hole 54 near the outer edge such that a tool may be inserted to assist the user in pulling out module 52. Contacts 70 provide an electrical interface to electrical components of module 52.

Alternatively, other forms of resilient connections between housing 16 and module 52 may be used. For example, rather than being an slot closed at both ends to form an attached web, an open ended slot may be used, with the detent extending from the distal end of the web. Further consistent with the teachings of this invention, the resilient component may also be formed as part of housing 16. Furthermore, detents 64, 66 may be components mounted to module 52 extending therefrom to operate as detents with engagement of housing 16.

Figure 11:
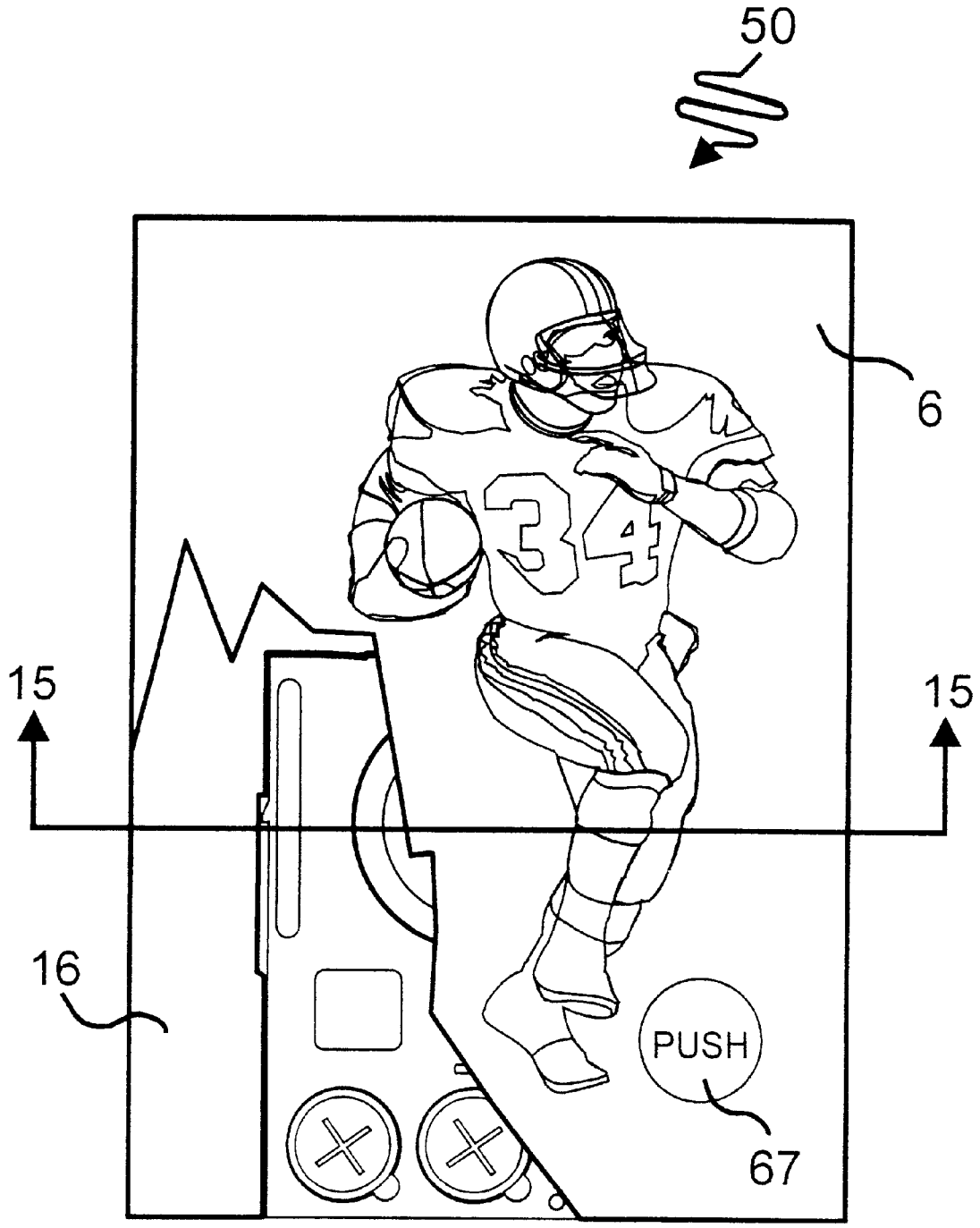
FIG. 11 is a top plan view of a completed communicating card, showing a football player graphic on the front partially broken away to reveal the structure beneath the top sheet.

FIG. 11 is a top plan view of completed communicating card 50, shown with a football player graphic on the front. In FIG. 11, top sheet 6 of communicating card 50 is partially broken away to show the structure there beneath. When pressure is applied to a sensitive region 69 of card 50, an appropriate communication is delivered through a communication interface. As illustrated with respect with the preferred embodiment in this application, the communication interface is a speaker 68 (see FIG. 15) and the communication which is delivered there through is a recorded message. It should be noted that communication interface, within the teachings of this invention, is not limited to an audible communication interface such as speaker 68, but also includes visual and tactile communication interfaces which generate the respective displays. Examples of visual communication interfaces include any interface which is capable of delivering a visually perceptible communication such as LEDs and liquid crystal displays. Tactile would include for example, vibration. Depending upon the purpose of the actuatable communicating card, the communication interface could even generate RF or other wireless signals or data stream or DTMF (dual tone modulation frequency) for use within an appropriate receiver. As used herein and in the claims, it will be understood that communication interface refers to any device which is capable of delivering communication, including for example, speakers, LEDs, liquid crystal displays, and even RF or other wireless signal generators. Applications for such communications include, for example, dialing cards (DTMF), data transfer (PCMCIA), (e.g., RF/wireless remote control).

In the preferred embodiment, speaker 68 is a piezoelectric device, although a miniature dynamic speaker may also be used if desired. As used herein and in the claims, it will be understood that "speaker" includes any device capable of generating sound waves. Note that, in the preferred embodiment, there are no holes in top sheet 6 for speaker 68. Note also that there are not holes for any other purpose either. While a hole in the top or bottom sheet of the housing to pass sound waves generated by speaker 68 may be desirable, it is not necessary. If it becomes practical to align openings accurately with the underlying component, such construction is considered within the scope of the teachings of this invention.

Figure 12:
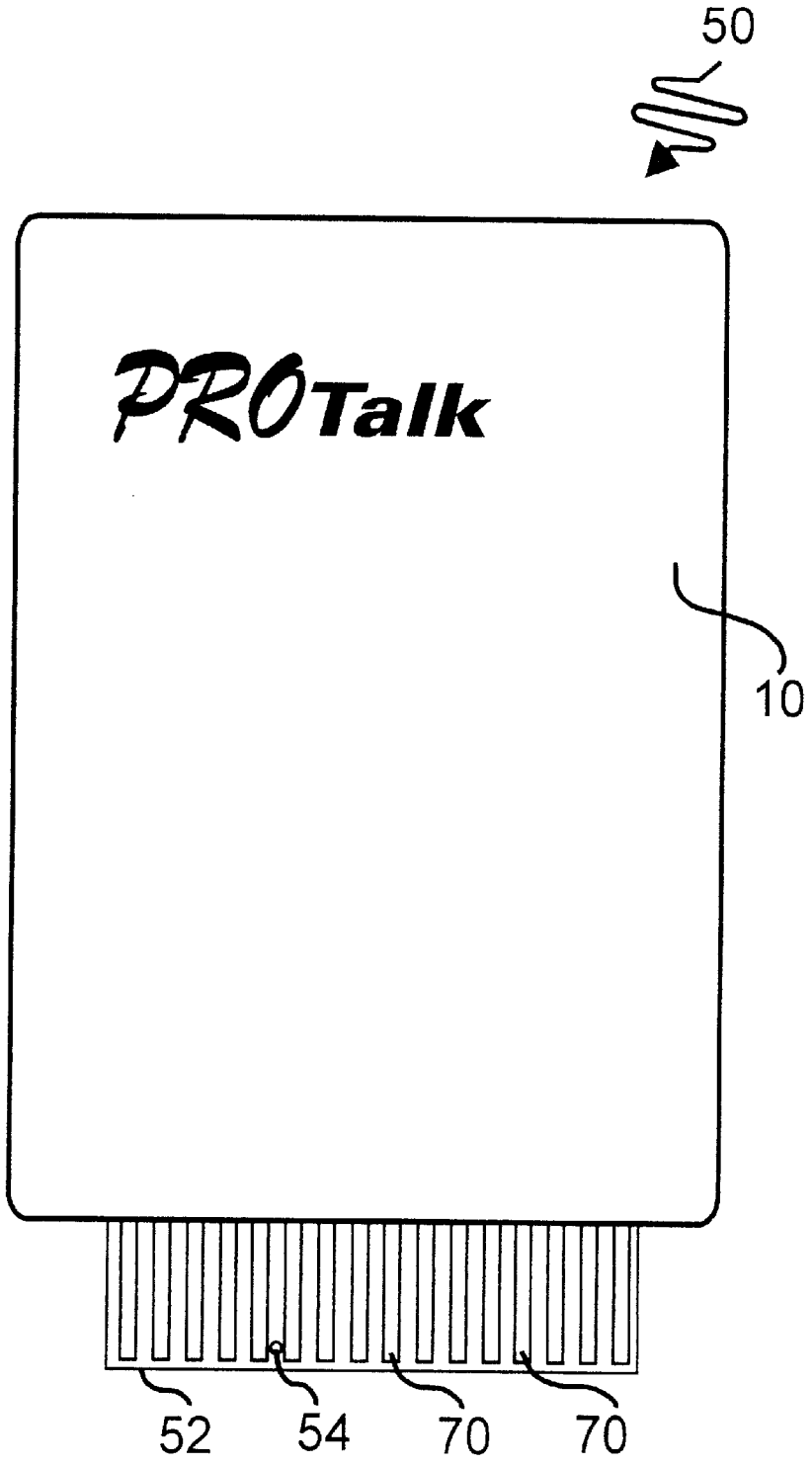
FIG. 12 is a plan view of the back of a communicating card with the contacts of the electronic module extending from the housing.
Figure 13:
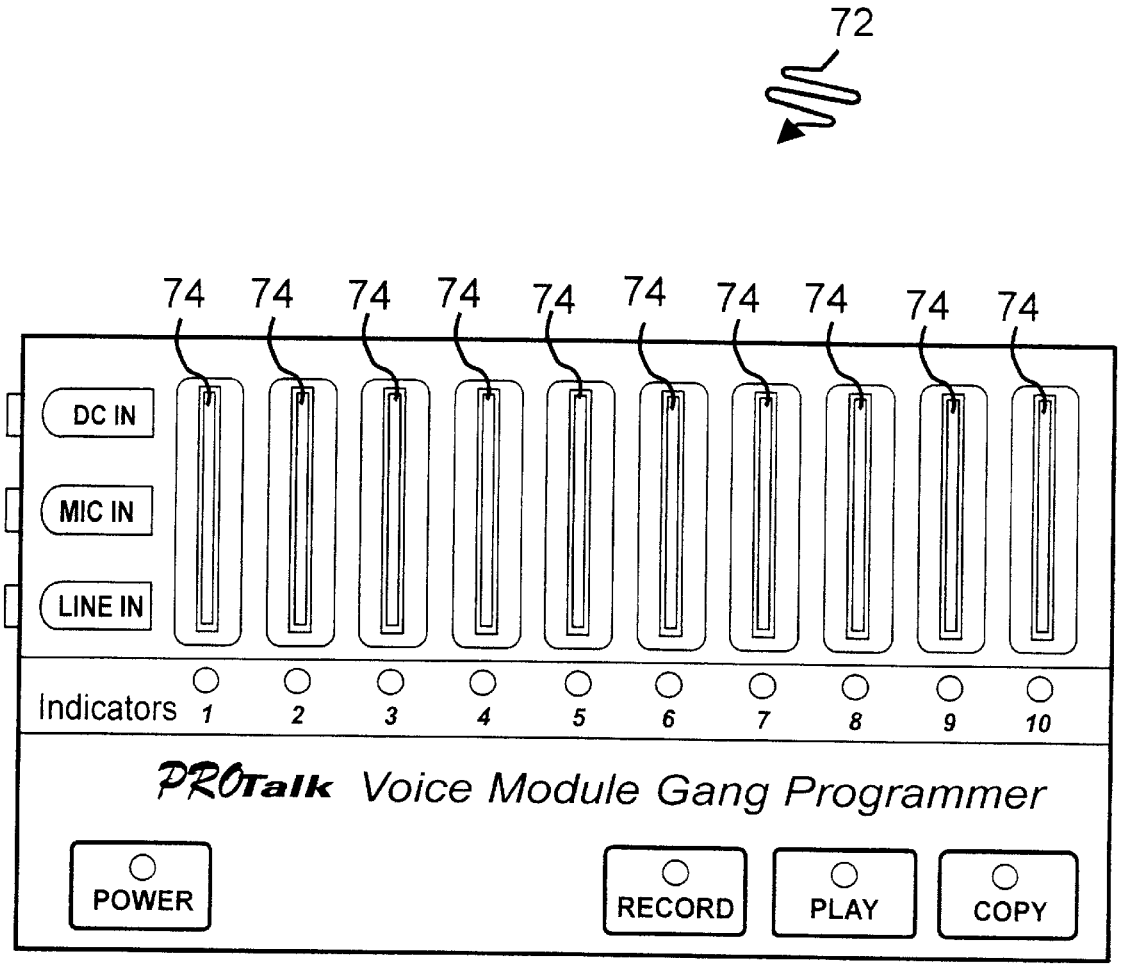
FIG. 13 is a front elevation view of a programmer having a plurality of slots for simultaneously programming a plurality of electronic modules.

FIG. 12 is a plan view of the back of communicating card 50. Bottom sheet 10 is visible, with module 52 extending out of housing 16. This side of module 52 has electrical contacts 70 of the type generally known as goldfingers. Contacts 70 are used for programming the memory carried by electronic module 52. Typically, a plurality of modules 52 are plugged into gang programmer 72, such as is depicted in FIG. 13, and are simultaneously programmed after being inserted into respective slots 74. Of course, programmer 72 may have any number of slots 74 as is practical, and modules 52 may be automatically inserted therein. Alternatively, other non-insertion type contacts may be used. Normally, programming is done without batteries installed (see below). If mistakes are made in programming, module 52 can be reprogrammed. With certain types of circuitry, such as voice synthesis technology, care must be exercised to avoid applying destructive electrical or electrostatic potentials.

Figure 14:
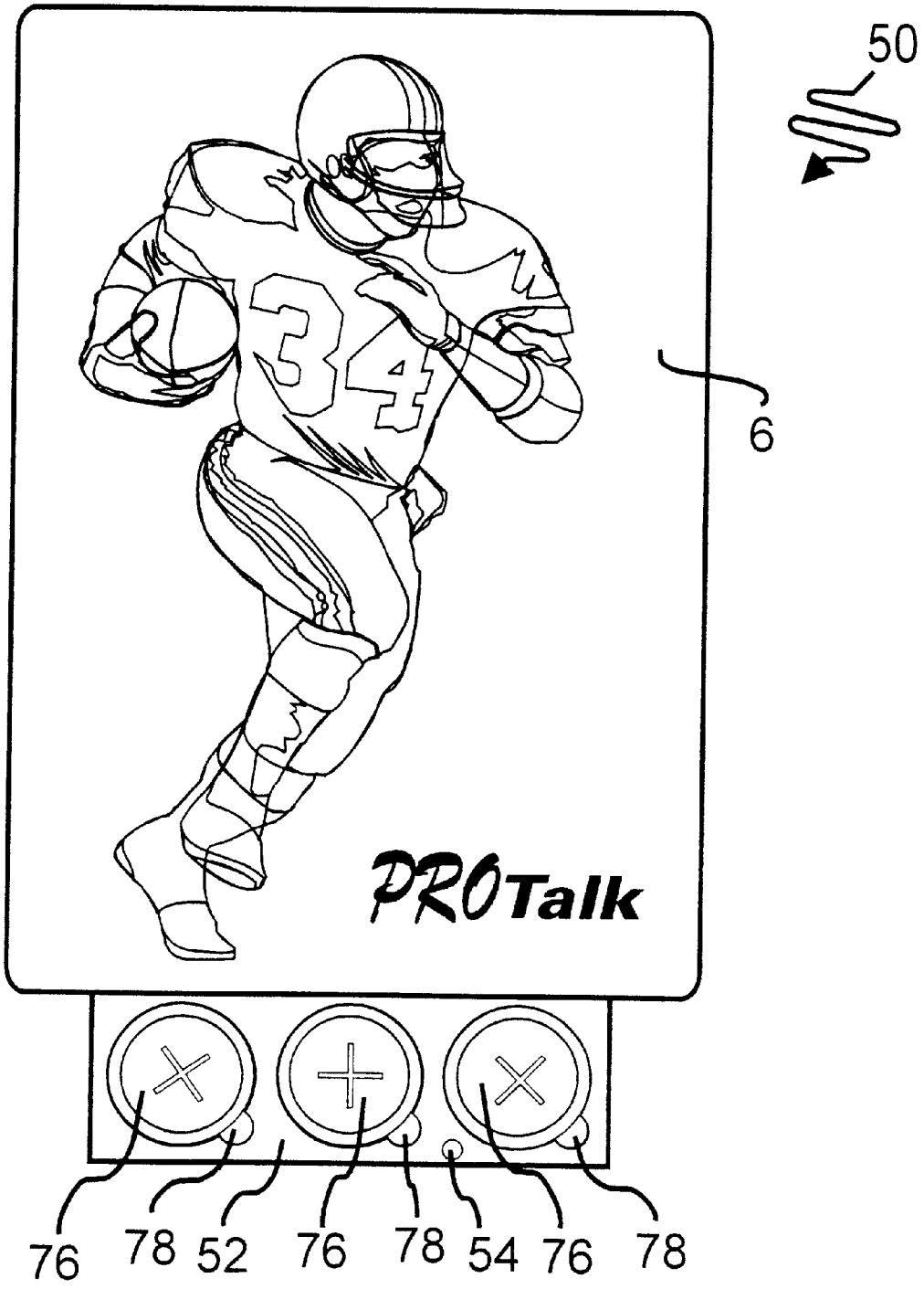
FIG. 14 is a plan view of the front of a communicating card shown in FIG. 12 with the batteries carried by the electronic module extending from the housing.

FIG. 14 is a top plan view of communicating card 50. Three dry cell batteries 76 are shown mounted to the front side of module 52. Batteries 76 may be thin button cell batteries or thin lithium cell batteries. The thickness of batteries 76 are a limiting factor in making module 52 ultra thin. The thickness of batteries 76 is typically from 1.0 mm to 2.5 mm. Three batteries 76 are illustrated in FIG. 14, but it will be understood that any appropriate number of batteries may be used depending upon the application, the battery voltage, the circuit board size, the type of communication interface used, the volume of the recorded message (in the case of a speaker) or the intensity or range of other communication delivery.

Although it is not absolutely necessary for the present invention, for most applications batteries 76 can be replaced when they are worn out. It is important to be able to easily change batteries 76, because in certain embodiments, such as collectible sports cards, the communicating card 50 needs to be able to communicate essentially forever, (i.e., by replacement of batteries). As will be appreciated, the value of a sports card version of the present communication card will be negatively impacted if the batteries cannot be replaced.

It is not desirable to provide an opening in either outer sheet of the communicating card 50 in order access batteries 76 for changing. There would be registration problems between the top or bottom sheets and the cavity 4 in center sheet 2 when making housing 50, because the manufacturing process would have to exactly match up the openings with the battery area. There are also aesthetic reasons not to form battery holes through the outer sheets. For this reason, module 52 is provided with the ability to slide out of housing 16 a limited distance. Recess 78 is provided adjacent each battery 76 so that battery 76 can be pried out of module 52, such as by use of fingernails or a small tool (not shown).

Figure 15:
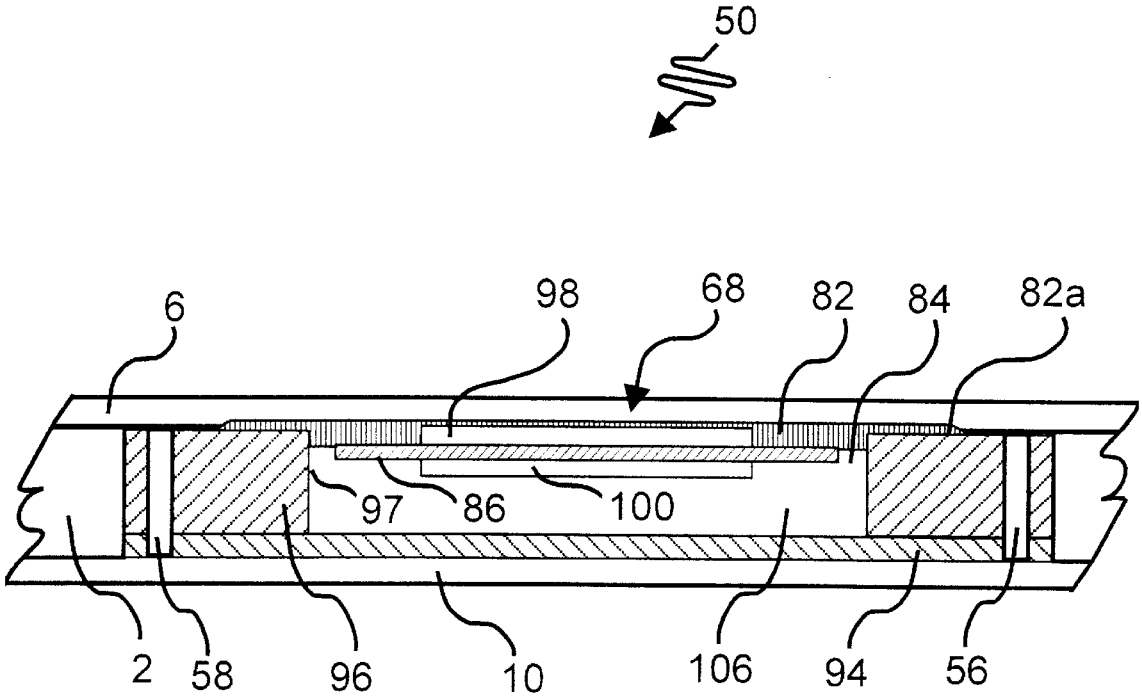
FIG. 15 is an enlarged, cross-sectional view of the communicating card of FIG. 11 taken along line 15—15 of FIG. 11.

FIG. 15 is cross sectional view of communicating card 50 taken along lines 15—15 of FIG. 11. In FIG. 15, housing 16 is illustrated with top sheet 6, bottom sheet 10, and electronic module 52 disposed within cavity 4, with speaker 68 mounted as shown.

Figure 16:
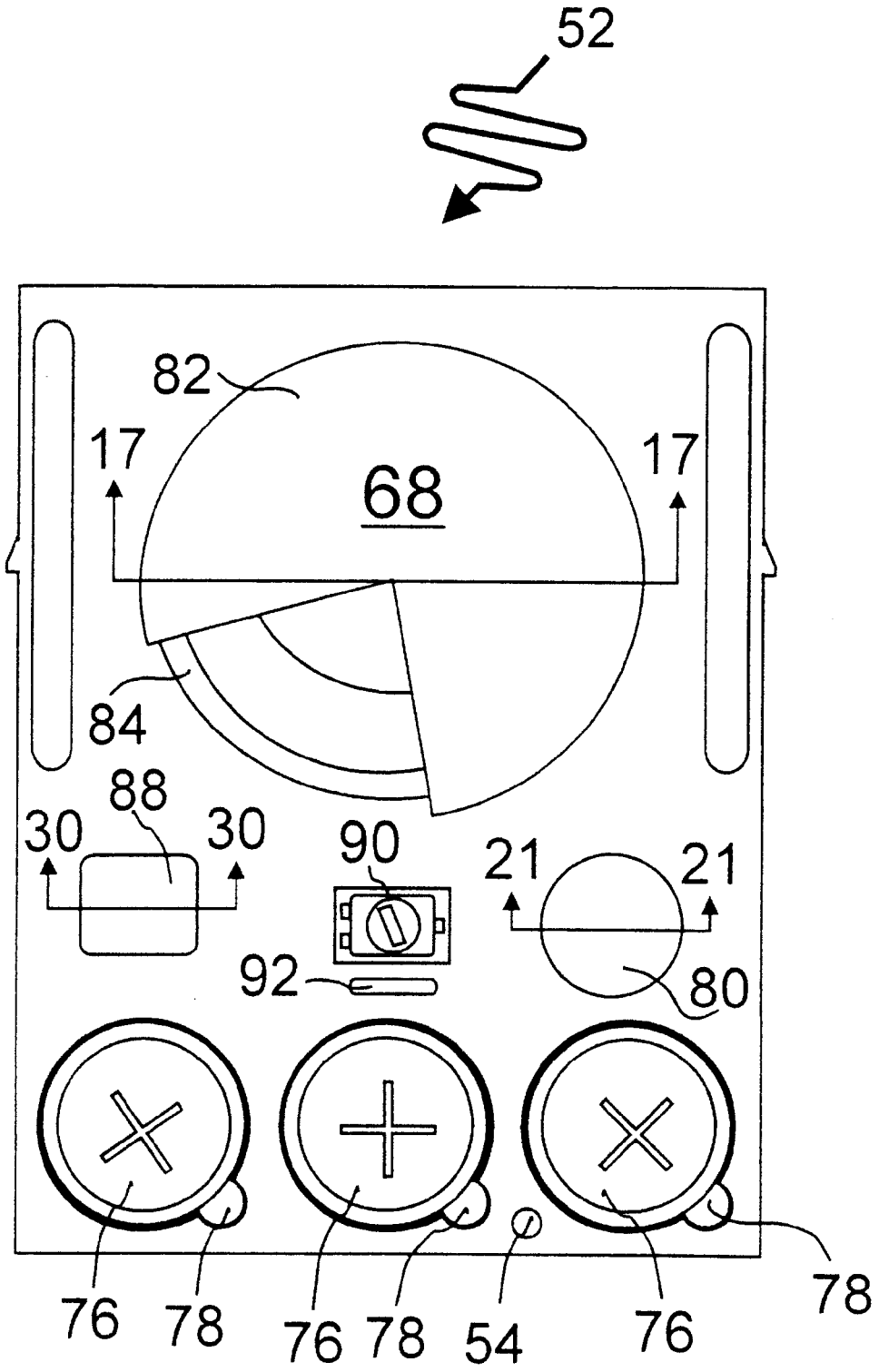
FIG. 16 is a plan view of the component side of the electronic module constructed in accordance with the principles and teachings of the present invention.

FIG. 16 is a top plan view of the component side of electronic module 52, showing speaker 68, with support 82 partially cut away to show gap 84 and middle element 86, batteries 76, and recesses 78 for accessing batteries 76 for removal. Electronic module 52 is also provided with actuator 80. Actuator 80 may be any appropriate component suitable for the particular application. For example, in a preferred embodiment, actuator 80 is a momentary contact normally open switch assembly. It may also be a light sensor, for example, which actuates communication delivery by the communicating card upon a change in the light sensed. As will be appreciated, many other forms of actuators may be used. It should be appreciated that while a single switch is used in the preferred embodiment, more than one switch may comprise the actuator.

Module 52 includes integrated circuit 88, which is a key element of the communicating card. Integrated circuit 88 may be made using voice synthesis technology, and can employ a wide variety of different types of voice or data memories. Integrated circuit 88 may employ a masked ROM, a one time programmable ROM, an EPROM, a EEPROM, flash memory and so on. The particular memory utilized will depend on module cost, flexibility and application. The specific construction and functionality of integrated circuit 88 depends upon the application for which the communicating card is being used. For example, integrated circuit 88 may be configured to generate RF or other wireless signals for delivery through the communication interface.

In the preferred embodiment, electronic module 52 is also provided with resistive element 90, which is used to adjust the sample rate in the voice chip technology. In flexible voice duration prototypes, an ultra tiny surface mount potentiometer can be used as resistive of element 90. A fixed resister may be used for the resistive element 90 in high volume production after the optimum resistance value has been determined.

As explained below, module 52 is also provided with security lock slot 92 which may be used to lock the module 52 in the "out" position, when inserted in programmer 11.

Figure 17:
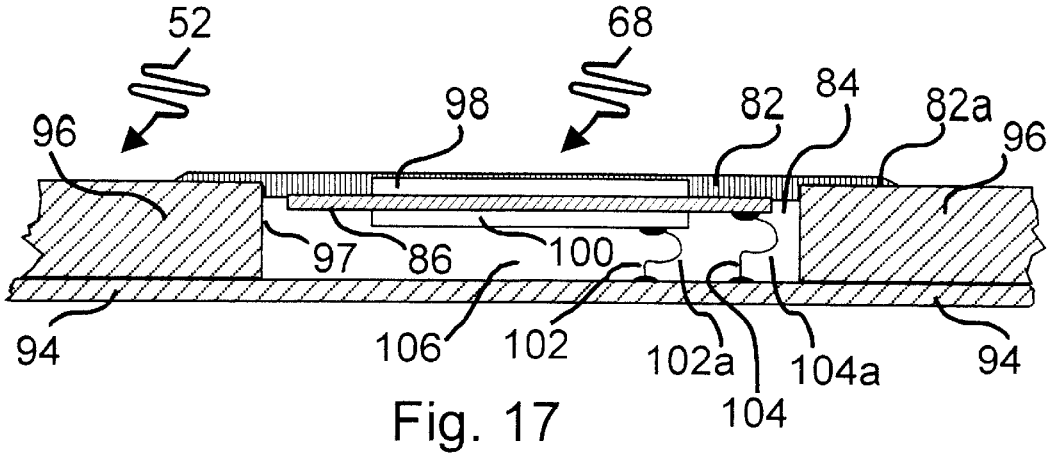
FIG. 17 is an enlarged fragmentary cross-section view of the electronic module of FIG. 16 taken along line 17—17 of FIG. 16.

FIG. 17 is an enlarged, fragmentary cross sectional view of electronic module 52 taken through line 17—17 of FIG. 16. Module 52 includes bottom printed circuit board (PCB) 94 and upper PCB 96, bonded together, along with copper printed circuits (not shown). Opening 97, which is shaped complimentary to communication interface 68 (in the preferred embodiment speaker 68), is formed in upper PCB 96.

Speaker 68, as shown in FIGS. 15 and 17, is a double-sided piezoelectric ceramic unit, as is well known, comprising upper and lower piezoelectric ceramic elements 98 and 100 carried by middle element 86 made of metal (such as steel or copper). Speaker 68 includes rigid pinout connectors 102 and 104 which are connected to appropriate points on the electrical circuit of lower PCB 94. Pinout connectors 102 and 104 include loops 102*a* and 104*a,* respectively, which provide some resilience to pinout connectors 102 and 104. As is well know, these connectors can be soldered or connected by any other suitable electrical connection. Solder paste may be used at the appropriate contact points on lower PCB 94, or pinout connectors may extend through holes (not shown) in lower PCB 94 and soldered from the bottom of lower PCB 94.

Speaker 68 includes support 82, made of foam, which supports elements 86, 98 and 100 disposed mostly in cavity 106. Upper piezoelectric ceramic element 98 is adhered directly to the lower surface of foam element 82. Foam element 82 includes thin portion or lip 82*a* which extends beyond the perimeter of opening 97, overlying the upper surface of upper PCB 96, being secured thereto. Lip 82*a* may be adhered to upper PCB 96 by any conventional means, such as glue. Preferably, lip 82*a* has been pre-adhesived with a pull off strip (not shown) allowing lip 82*a* to be adhered directly to PCB 96 without a separate gluing step. Elements 86 and 98 are similarly adhered to foam element 82.

Foam element 82 locates middle element 86 spaced apart from opening 97 by gap 84. This allows the elements to vibrate without grounding against upper PCB 96, thereby improving the sound quality of lower frequencies.

Except for lip 82*a,* foam element 82 is generally of uniform thickness. Although preferable, uniform thickness is not necessarily an absolute requirement. In FIG. 15, the portion of foam element 82 adjacent upper piezoelectric ceramic element 98 is shown compressed, with the entire upper surface of foam element 82 in direct contact with the lower surface of top sheet 6. This direct contact provides good acoustical coupling between the speaker and housing 16 through top sheet 6, and improves the transmission of sound. Although other densities may be used, a medium density foam has demonstrated good sound transmission to the top sheet. A high density foam may tend to deflect the top sheet outwardly.

Foam was selected for its flexibility, thinness and sound transmission characteristics when abutting top sheet 6. A solid element could be used to carry elements 86, 98 and 100 instead of foam element 82, but it must have sufficient structural strength so as not to be broken. The desire to keep communicating card 50 as thin as possible precludes the use of a very thick solid element. Currently available cost effective plastic, although its rigidity would be useful in the transmission of sound to top sheet 6, is too brittle when used as a thin sheet and could not withstand the likely forces which may be exerted on the outside of card 50. A flexible element is thus preferred.

Although speaker 68 is shown as carried by electronic module, it or any communication interface could alternatively be carried by housing 16, so long as any necessary electrical coupling between the speaker or interface occurred, whether, for example, by direct electrical connection or by inductance, etc.

Cavity 106 provides some ease in the assembly of speaker 68 to electronic module 52, providing clearance. However, cavity 106 is not necessarily an indispensable part of all embodiments of this invention. Cavity 106 could be smaller, or an additional element, such as foam, could be secured to element 86.

Figure 18:
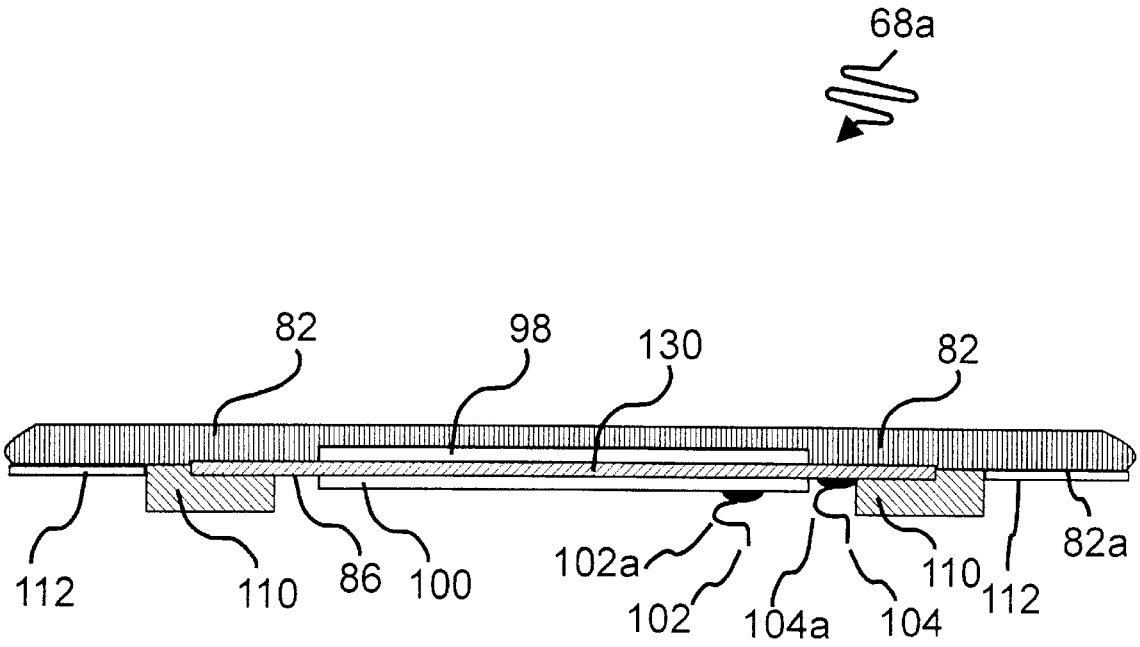
FIG. 18 is an enlarged cross-sectional view of an alternate embodiment of the speaker.

FIG. 18 is an enlarged cross-sectional view of an alternate embodiment of speaker 68*a*. In this view, an additional foam element 100 is adhered to the bottom of foam element 82, partially sandwiching middle element 86 therebetween. The outer perimeter of foam element 110 is complementarily shaped to opening 97. Peel off strip 112 covers the adhesive on the lower surface of lip, which secures speaker 68*a* to electronic module 52. This embodiment is particularly suited for cards which are as thin as approximately 1 mm. Foam element 110 prevents ceramic wafer 100 from grounding against the bottom of cavity 106 (the upper surface of lower PCB 94) not shown , which would have deleterious effects on the sound quality.

Figure 19:
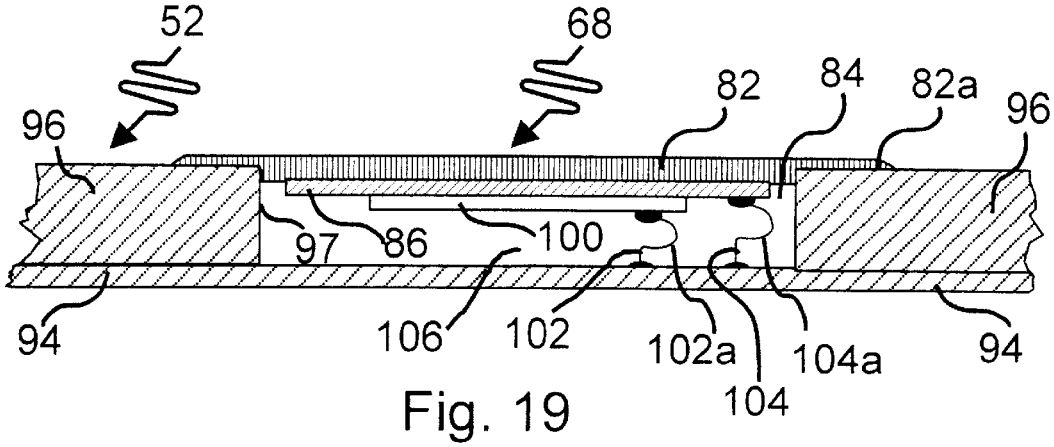
FIG. 19 an enlarged fragmentary cross-sectional view similar to FIG. 17 showing an alternate embodiment incorporating a single sided piezoelectric unit.

FIG. 19 illustrates an alternate embodiment of speaker 68. In FIG. 19, speaker 68 is a single-sided piezoelectric unit having only lower piezoelectric ceramic element 100. As seen in the embodiment of FIG. 19, foam layer 82 is essentially the same thickness across opening 97.

Figure 20:
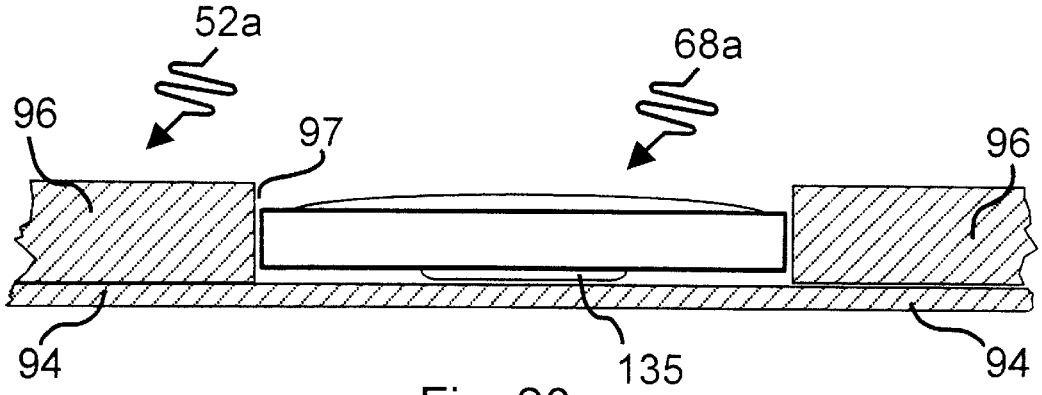
FIG. 20 an enlarged fragmentary cross-sectional view similar to FIG. 17 showing an alternate embodiment incorporating a dynamic speaker.

FIG. 20 shows yet another embodiment, illustrating dynamic speaker 68*a*. Speaker 68*a* is disposed within opening 97 such that no portion of speaker 68*a* extends substantially above the upper surface of upper PCB 96. Speaker 68*a* includes magnet 135 which rests directly on lower PCB 94.

Figure 21:
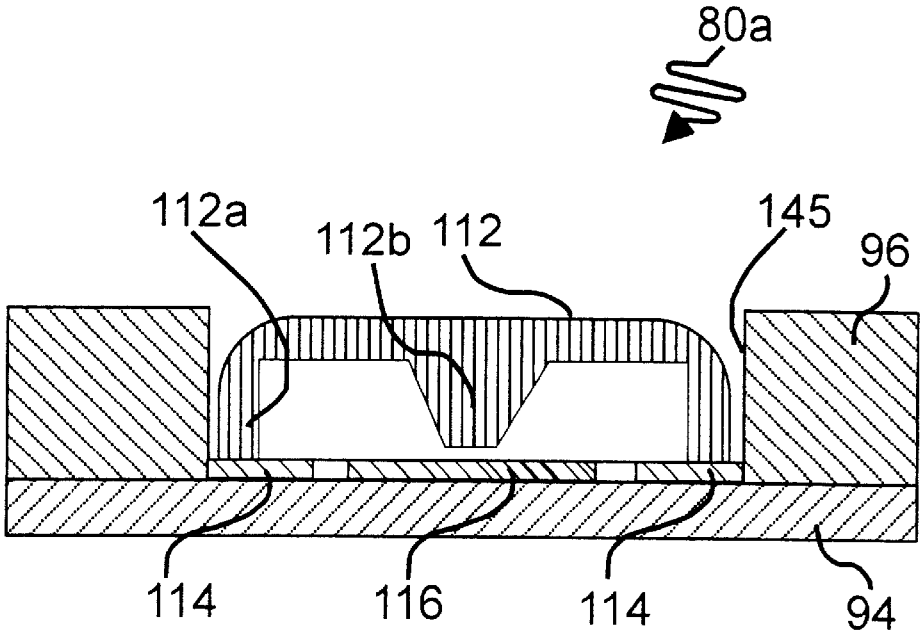
FIG. 21 is an enlarged, fragmentary cross-sectional view taken along line 21—21 of FIG. 16 showing a push button switch assembly in accordance with one embodiment of the present invention.

FIG. 21 is an enlarged cross sectional fragmentary view taken along line 21—21 of FIG. 16, showing an embodiment of actuator 80, in this case a push button assembly 80*a*. Electrically conductive, flexible dome 112 is shown disposed with opening 145 formed in upper PCB 96. Preferably, the upper surface of dome 112 does not extend substantially beyond the upper surface of upper PCB 96. Lower PCB 94 includes electrical contacts 114 and 116. The outer upright portion 112*a* of dome 112 rests in electrical contact with contacts 114 as illustrated in FIG. 21. Dome 112 includes central extension 112*b* which overlays contact 116, but does not contact contact 116 in the normal position. In order to actuate communicating card 50, electrical contact between contacts 114 and 116 must be established. This is accomplished by momentarily depressing dome 112 such that extension 112*b* contacts contact 116 thereby completing the circuit. The signal generated by this closure actuates communicating card 50 to deliver the communication.

Figure 22:
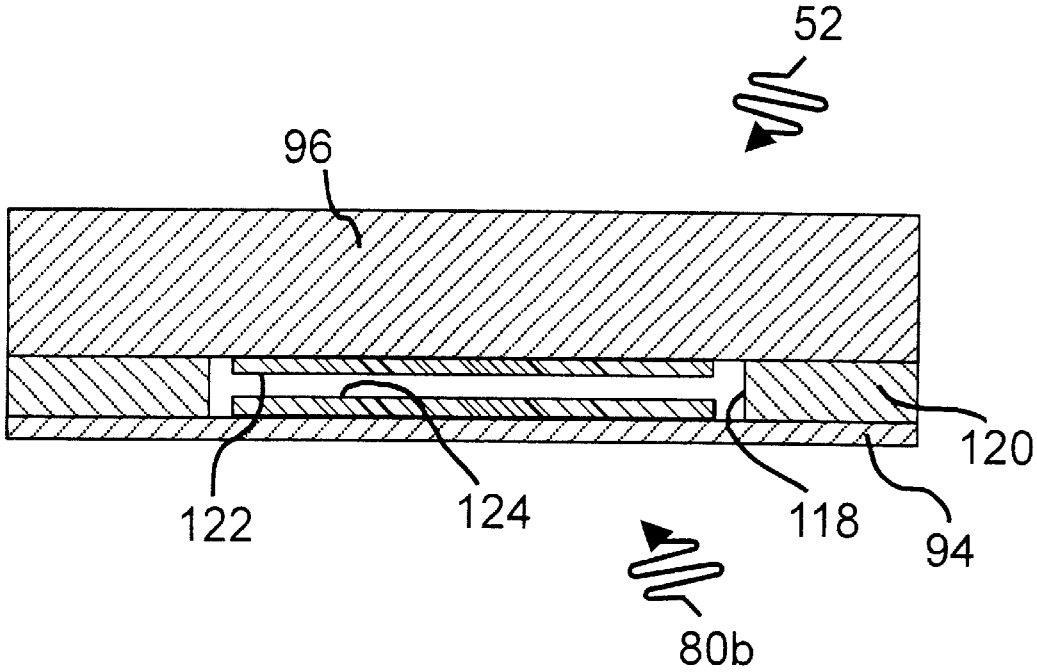
FIG. 22 is an enlarged, fragmentary cross-sectional view similar to FIG. 21 showing an alternate embodiment of a push button switch assembly.

FIG. 22 illustrates an alternate push button assembly 80*b* which may be used when electronic module 52 comprises three layers. It is noted that the reference to layers is to three fiber layers, not three electrical layers, such as multiple copper traces which are well known for use on a single PCB. The configuration illustrated in FIG. 22 includes upper PCB 96 lower PCB 94 and middle PCB 120. Opening 118 is formed in middle PCB 120. Electric contact 122, carried by upper PCB 96, overlays electrical contact 124, carried by lower PCB 94. Electrical contact 122 and 124 may merely be exposed/uninsulated portions of the electrically conductive traces. To actuate communicating card 50, the areas over lying and under lying opening 118 are forced together such that direct electrical contact is made between electrical contacts 122 and 124. Middle PCB board 120 may include traces as desired for the particular PCB design. It is noted that, at a minimum, there must be some electrical connection between the traces on upper PCB 96 and lower PCB 94 in order to form a complete circuit.

It is contemplated that the actuation device of the communicating card may be constructed to withstand a distributed heavy weight without closing the electrical contact. For example, if the communicating card were packaged with another product which might, in shipment or distribution, be stacked one on top of the other, then the actuator would have to be configured not to make electrical contact when so stacked.

Figure 23:
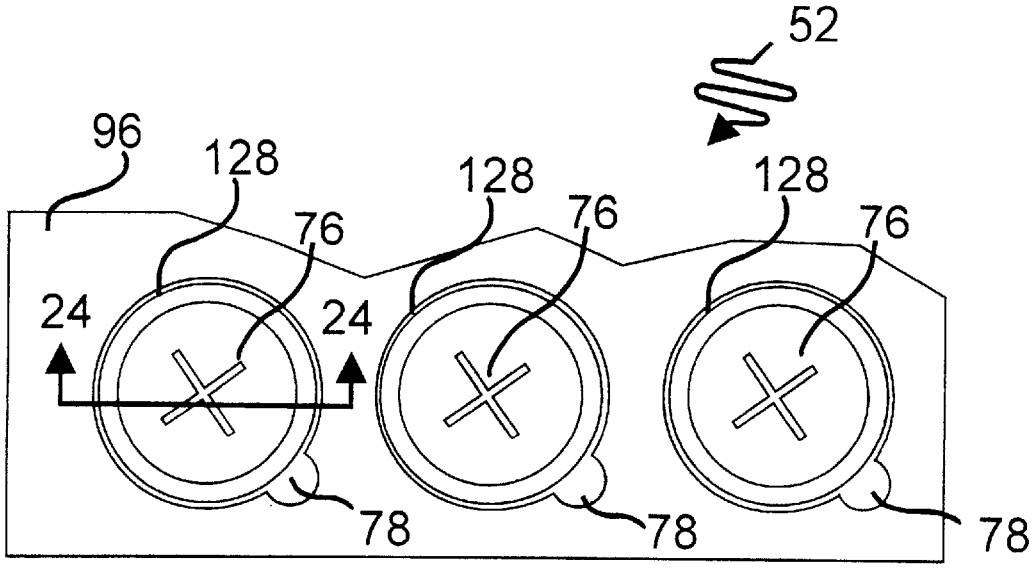
FIG. 23 is an enlarged fragmentary top plan view of the battery holder portion of the electronic module of a preferred embodiment of the present invention..
Figure 24:
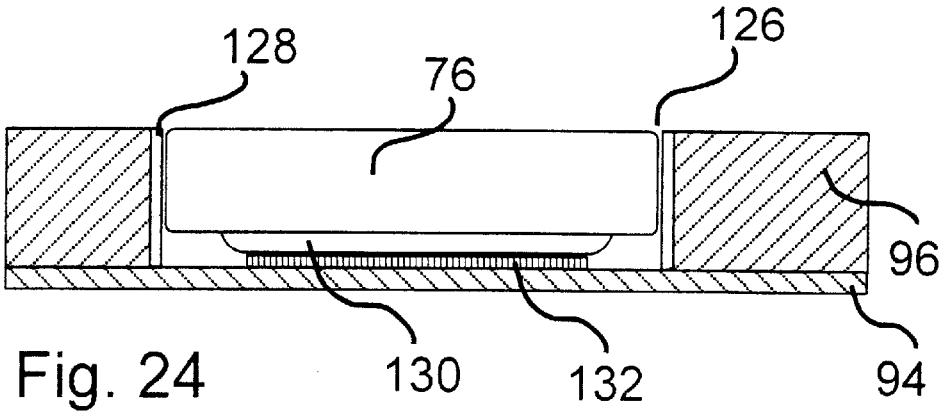
FIG. 24 is an enlarged fragmentary cross-sectional view taken along line 23—23 of FIG. 23.

FIG. 23 is an enlarged, fragmentary top plan view illustrating the battery holder portion of module 52. FIG. 24 is an enlarged, fragmentary cross sectional view of one battery 76 taken along line 24—24 of FIG. 23. As shown in FIGS. 23 and 24, upper PCB 96 includes opening 126, having gold plated copper contact 128 disposed adjacent thereto. It is noted that contact 128 is generally circular in shape but does not extend past recess 78 as shown in FIG. 23 so as to allow access to battery 76 through recess 78.

Although three batteries are shown, the number of batteries used depends on the electrical requirements of the application and the energy characteristics of the battery. It should be noted that the thickness of the batteries is the primary constraint on the thinness of the communicating card. For example, in a preferred embodiment, the overall thickness was 2.5 mm with batteries 2.0 mm thick. With batteries 1.0 mm thick, a card approximately 1.4 mm thick could be manufactured.

Battery 76 is in direct electrical contact with contact 128 at some point around its circumference. Battery 76 also has center terminal 130 at its bottom, which makes electrical contact with circular gold plated copper contact 132 carried by lower PCB 94. Although gold contacts are used for their excellent conductive and durability properties, other materials may be used without deviating from the teachings of the invention.

Figure 25:
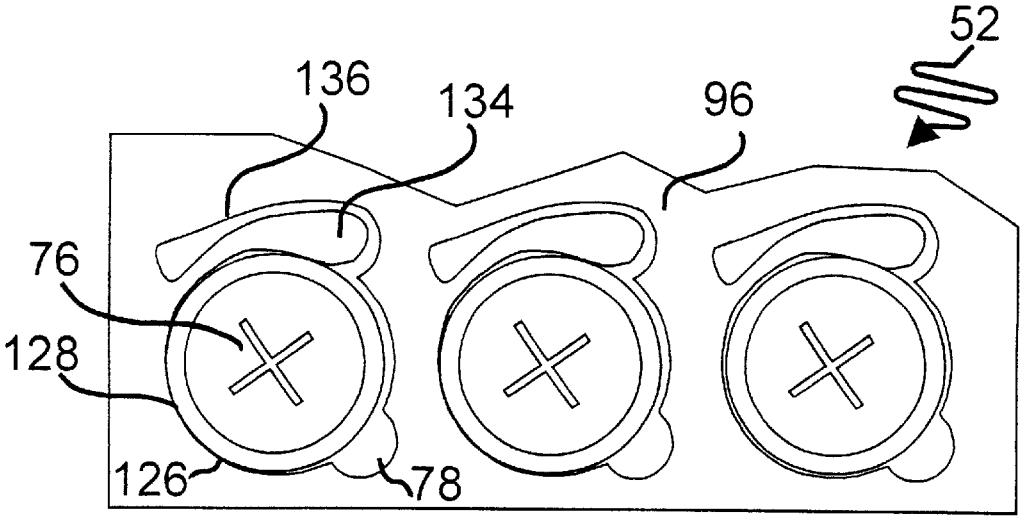
FIG. 25 is an enlarged fragmentary top plan view of an alternate embodiment of the battery holder portion of the electronic module.

FIG. 25 is an enlarged, fragmentary top plan view of an alternate embodiment of the battery holder portion of electronic module 52. In this embodiment, upper PCB 96 additionally includes elongated fingers 134 defined by elongated opening 136 which communicates directly with opening 126. In this embodiment, finger 136 extends into opening 126 when no battery is present, i.e. the relaxed state. When battery 76 is inserted in opening 126, finger 134 resiliently urges battery 76 against the opposite wall of opening 126. Electrical contact 128 is disposed in opening in 126 as described above with respect to FIGS. 24 and 25, such that the at least a portion of the circumference of battery 76 is placed in electrical contact therewith. Other resilient retention means may be used within the spirit of this invention.

Figure 26:
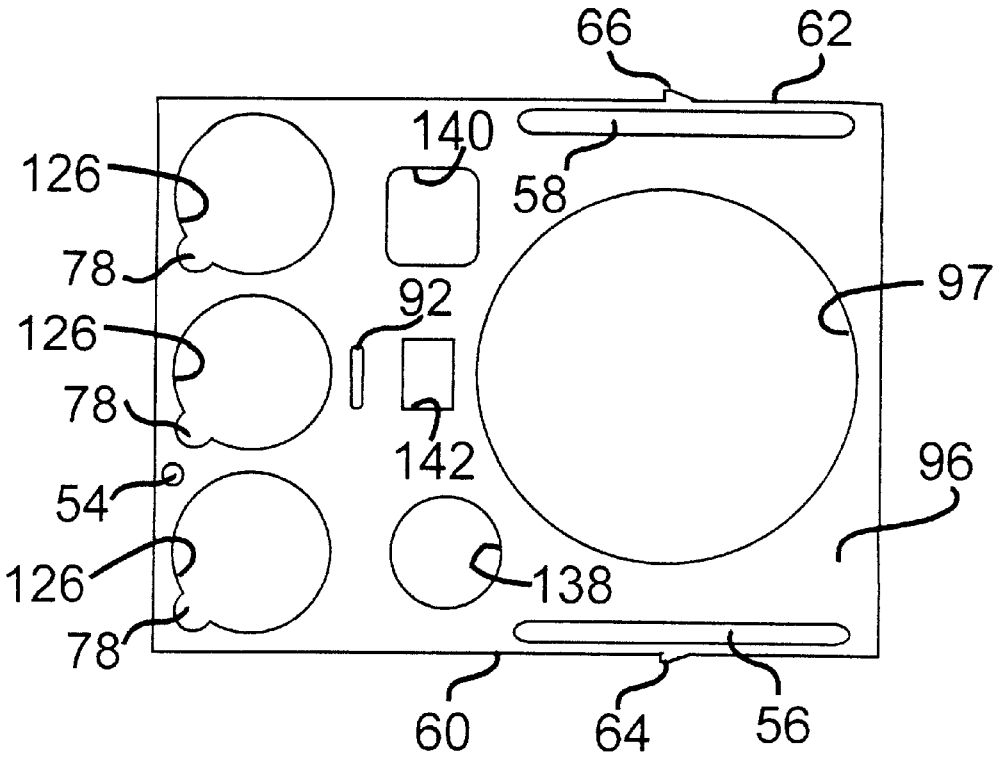
FIG. 26 is a top plan view of the upper printed circuit board constructed in accordance with the principals and teachings of the present invention.
Figure 27:
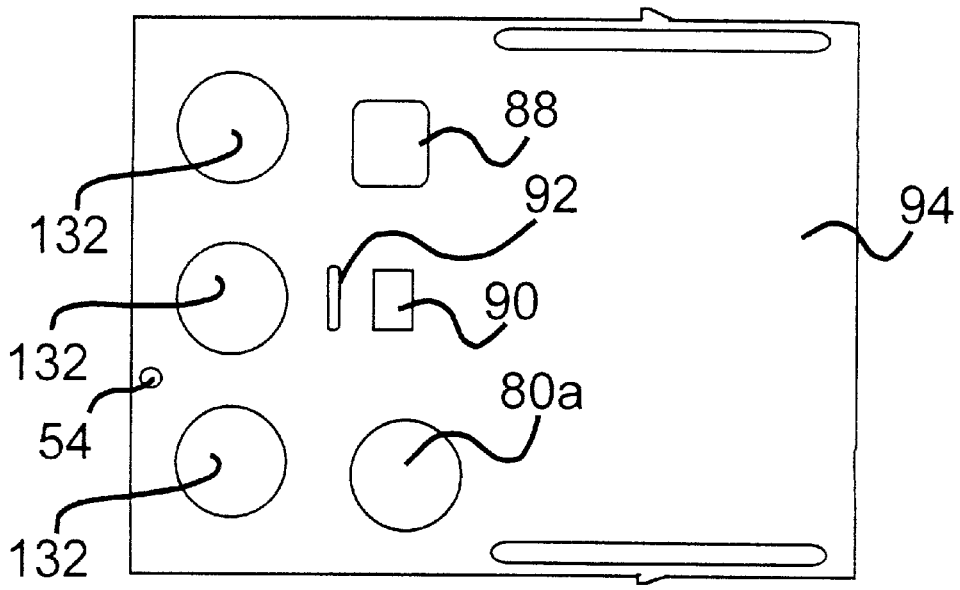
FIG. 27 is a top plan view of the lower printed circuit board constructed in accordance with the principals and teachings of the present invention.

FIG. 26 is a top plan view of upper PCB 96, showing opening 97 for receiving speaker 68 (not shown on FIG. 26). FIG. 27 is a top plan view of lower PCB 94, diagrammatically illustrating certain components and features, but omitting the copper traces and pads which form the printed circuit. As shown in FIG. 27, lower PCB 94 includes electrical contact 132, switch assembly 80*a,* and carries integrated circuit 88 and resistive element 90. As shown in FIG. 26, upper PCB 96 includes openings 126, 138, 140 and 142 for receiving those components carried by lower PCB 94. Openings 126, 138, 140 and 142 are aligned with their respective components.

To form module 52, in accordance with the preferred embodiment, upper PCB 96 is adhered to lower PCB 94. It should be noted that both upper and lower PCB 96 and 94 include the respective configurations which form elongated slots 56 and 58, webs 60 and 62 and detentes 64 and 66 of completed module 52.

Figure 28:
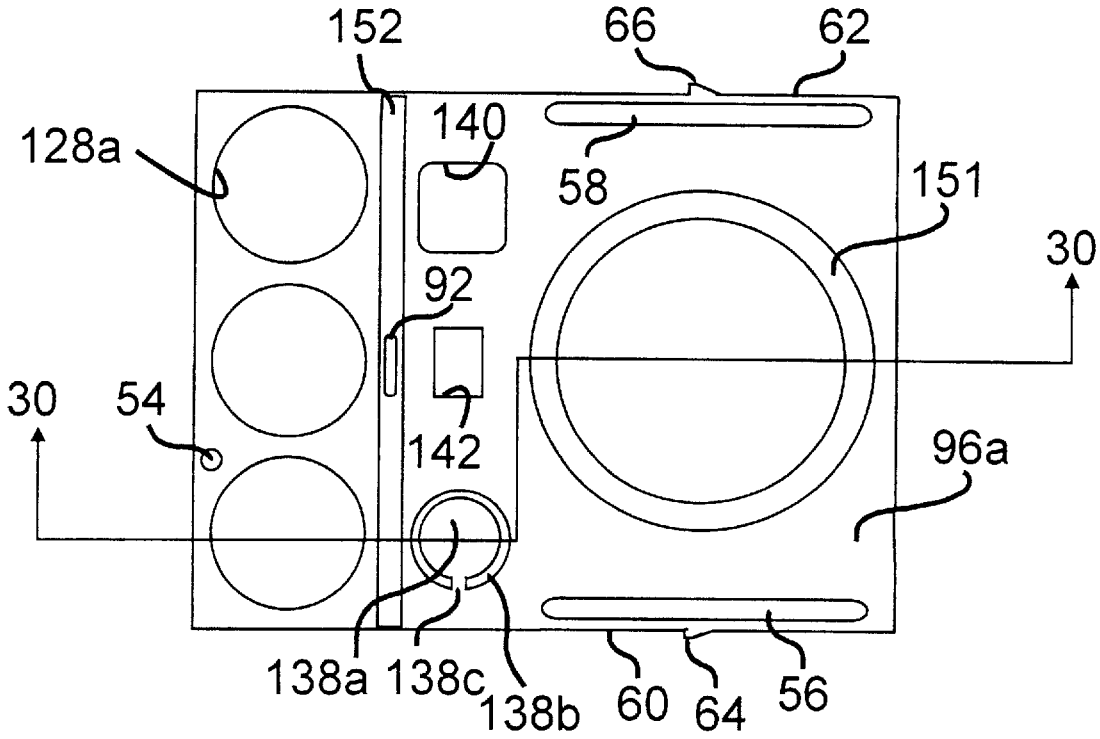
FIG. 28 is a top plan view of the upper layer of an alternate embodiment of the electronic module of the present invention.
Figure 29:
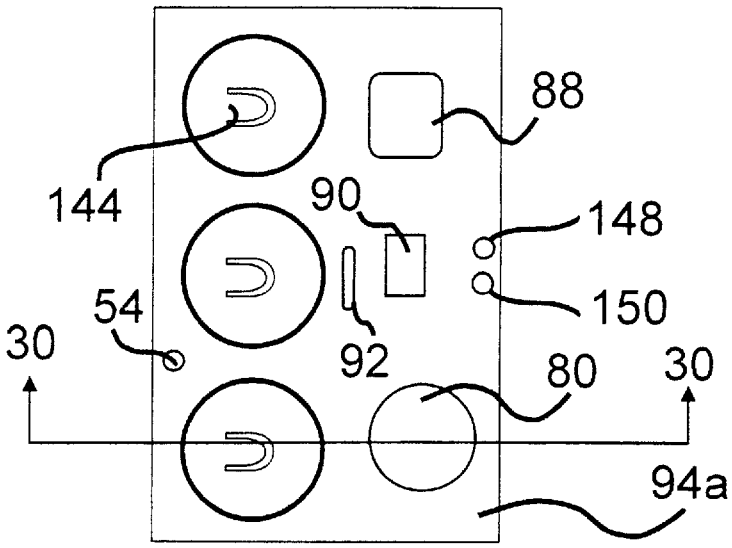
FIG. 29 is a top plan view of the lower printed circuit board of an alternate embodiment of the electronic module of the present invention.
Figure 30:
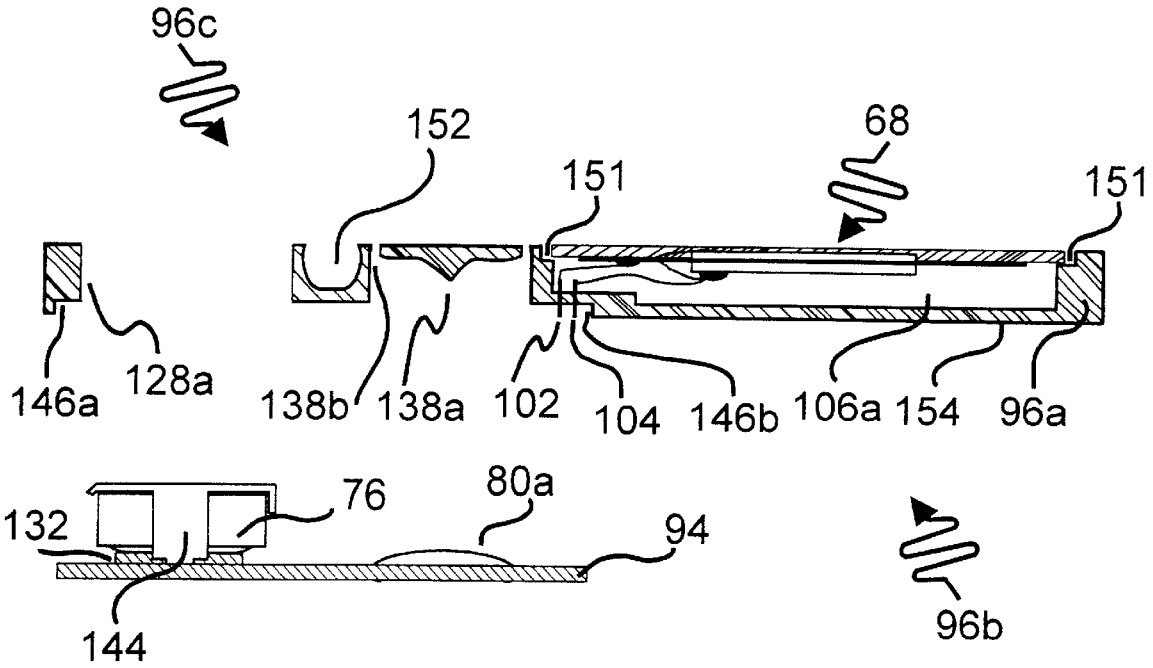
FIG. 30 is an enlarged, exploded side view taken along line 30—30 FIG. 28 and line 30—30 of FIG. 29 of the alternate embodiment of the electronic module of the present invention.

FIGS. 28, 29 and 30 illustrate an alternate embodiment of electronic module 52. In this embodiment, the electronic module, generally designated as 52*a,* includes upper layer 96*a* and lower PCB 94*a,* as best seen in FIG. 30. Upper layer 96*a* is made of plastic and includes hinge 96 which separates upper layer 96*a* into upper portion 96*b* and a lower portion 96*c*. Referring to lower PCB 94 as shown in FIGS. 29 and 30, a similar configuration to lower PCB 94*a* as described previously is seen. Lower PCB 94*a* carries integrated circuit 88, potentiometer 90 and batteries 76. Additionally, battery holders 144 are carried by lower layer 94*a*. Battery holders 144 have open sides and a top such that batteries 76 may be slid in from the side as best seen in FIG. 30. Electrical contact 132 for the lower center portion of battery 76 is still carried by lower PCB 94*a*.

Upper layer 96*a* is configured to receive lower PCB 94*a* between edges 146*a* and 146*b*. Lower PCB 94*a* may be secured to upper layer 96*a* by any conventional means, such as glue or a snap fit. In conjunction with this assembly, lower PCB 94*a* is provided with openings 148 and 150, as seen in FIG. 29, for receiving pinout connectors 102 and 104 of speaker 68. Pinout connectors may then be soldered to complete the appropriate electrical connections.

Upper layer 96*a* includes disc portion 138*a* which is formed by annular opening 138*b*. Disc portion 138*a* remains connected to upper layer 96*a* by portion 138*c*. As can be seen in FIG. 30, disc 138*a* overlays switch dome 80*a* such that when lower PCB 94*a* is assembled to upper layer 96*a,* disc 138*a* may be depressed to engage dome 80*a,* closing the electrical circuit to actuate the communicating card. Because batteries 76 are installed in battery holders 144 from the side, lower portion 96*c* is hinged to upper layer 96*a* through hinge 152. This allows lower portion 96*c* to be flipped up and batteries 76 accessed when lower portion 96*a* of module 52*a* is exposed out of housing 16.

As can be seen in FIG. 30, upper layer 96*a* includes speaker cavity 106*a* which is enclosed on the bottom side. Alternatively, the bottom portion 154 of upper layer 96*a* may be omitted with lower PCB 94*a* extending the full length of module 52*a*. Speaker 68 is received by upper layer 96*a* as shown. As can be seen, upper layer 96*a* is configured to receive speaker support 151.

Various alternatives to the embodiments shown in FIGS. 28–30 may be used without departing from the teachings of this invention. For example, a removable battery cover, with opening/slots for the batteries may be used instead of an attached, hinged battery cover. Ridges may be provided on the edges of the electronic module for better gripping when the module is removed. The cavity underlying the speaker may be open to allow the pinout connectors to extend to the lower PCB. The upper layer may include locating pads, bumps, or any other structures to register with the PCB to provide positive or at least better locating.

Figure 31:
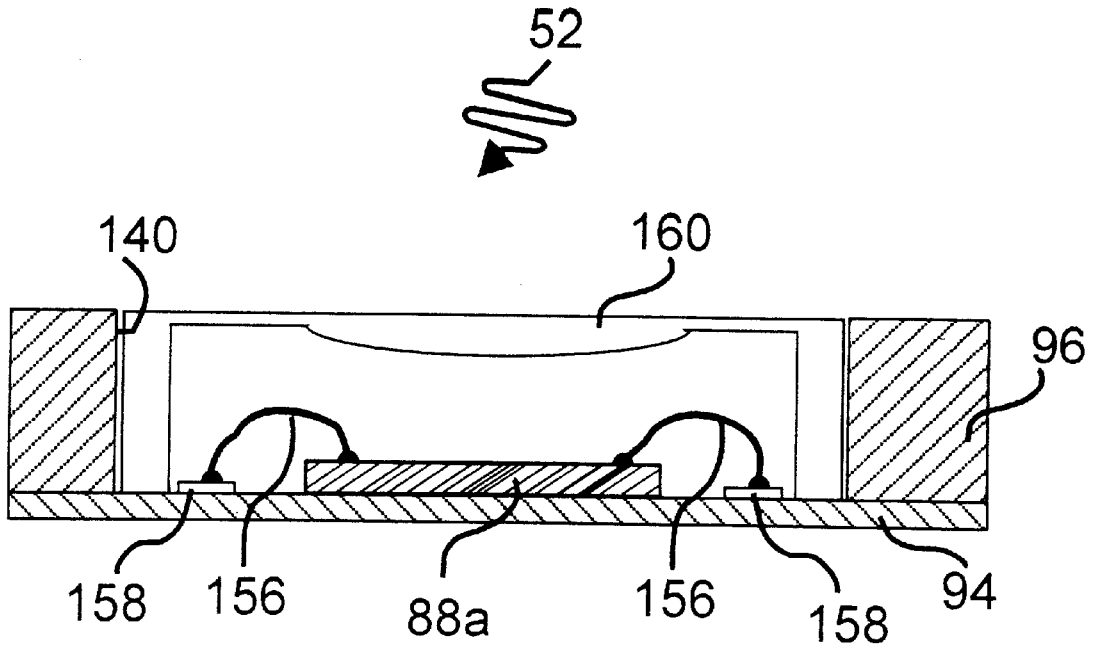
FIG. 31 is an enlarged fragmentary cross sectional view taken along line 30—30 of FIG. 16 showing the integrated circuit.

FIG. 31 is an enlarged fragmentary cross sectional view taken along line 30—30 of FIG. 16. Disposed within cavity 140 is integrated circuit 88*a,* mounted to lower PCB 94 in a type of mounting referred to as "chip on board." Integrated 88*a* is connected by wires 156 to connecting respective pads 158 disposed on lower PCB 94. It is to be understood that there are a plurality of wires 156 and connecting pads 158, not all of which are illustrated in FIG. 31. The construction shown in FIG. 31 allows the use of a UV erasable chip. The top of UV transparent cover 160 is approximately level with the upper surface of upper PCB 96, minimizing any indication of the underlying cavity 140 through the top sheet of the card. To erase the programming of chip 88, UV light is impinged on chip 88.

Figure 32:
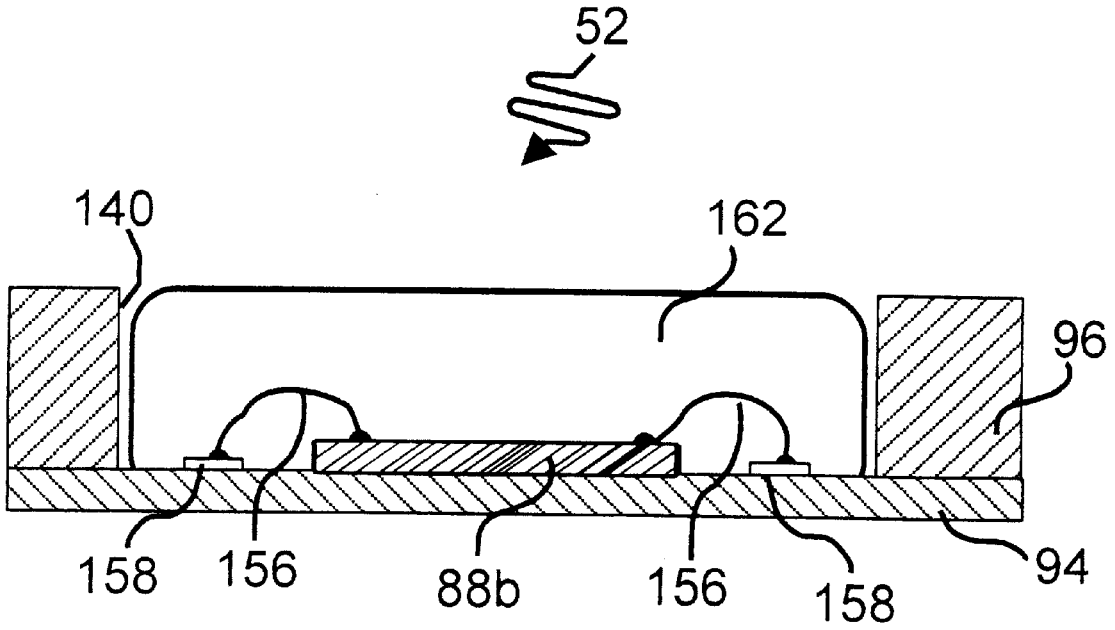
FIG. 32 is an alternate embodiment of that shown in FIG. 31.

FIG. 32 is an alternate embodiment of that shown in FIG. 31 utilizing a chip which is not UV erasable. In such case, chip 88*b* does not have to be accessibly by UV light. Standard epoxy 162 is used to fill in cavity 140 to avoid the presence of an indentation visible through the top sheet of the housing (not shown).

Figure 33:
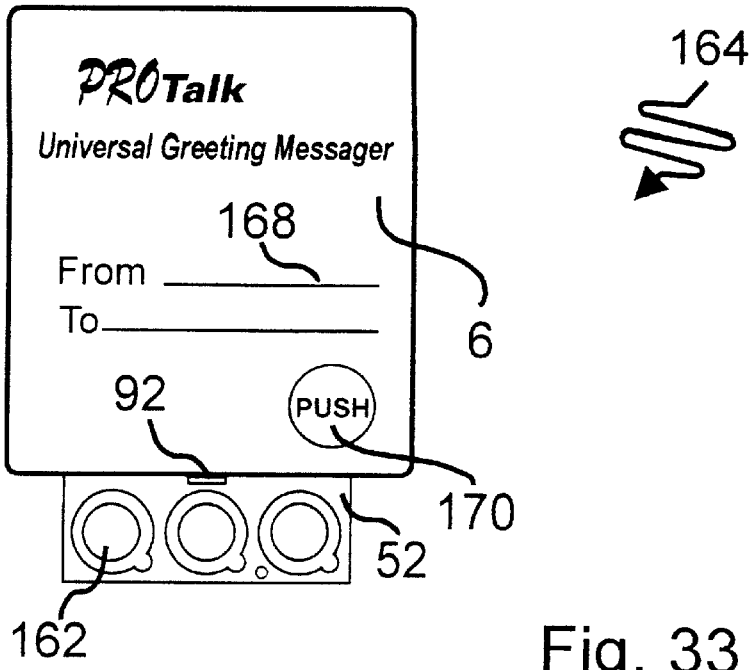
FIG. 33 is a plan view of the front of an alternate embodiment of a communicating card with the battery portion of the electronic module extending from the housing.
Figure 34:
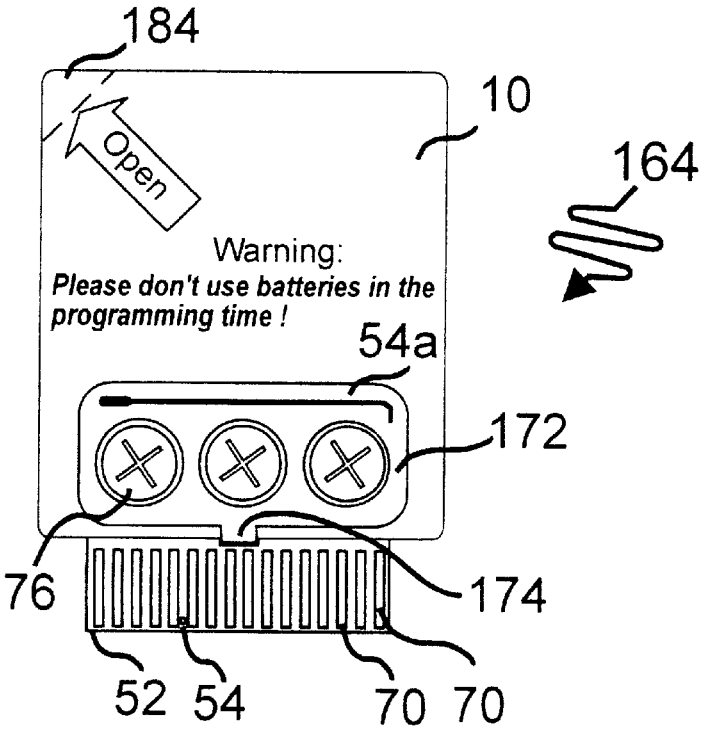
FIG. 34 is a plan view of the other side of the embodiment shown in FIG. 33 with the contacts of the electronic module extending from the housing.
Figure 35:
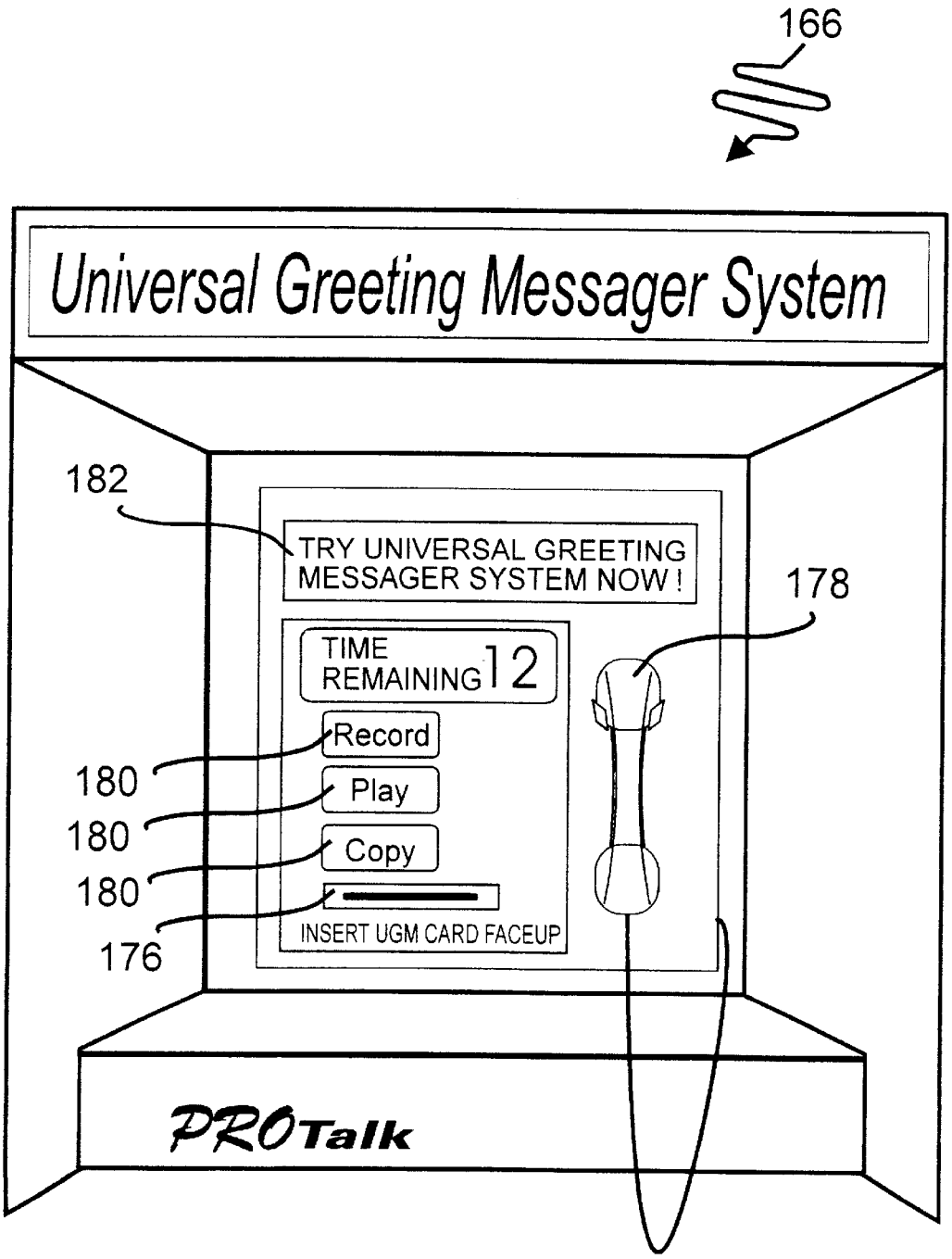
FIG. 35 is a front elevation view of a programmer that may be used to program an message into the communicating card depicted in FIGS. 33 and 34.

As indicated above, the present invention is a communicating card. One form of a communicating card constructed according to the teachings of the present invention is a talking trading card. Another form, as illustrated in FIGS. 33 and 34, is universal greeting messager 164, onto which a personalized message may be recorded by using a universal greeting messager programmer 166 as shown in FIG. 35. FIG. 33 is a front view of messager 164 with the battery portion of electronic module 52 extending from the external cavity of the housing. Top sheet 6 is provided with printed legends thereon including portion 168 having places in which the name of a sender and the name of a receiver may be written. Top sheet 6 may also include written indicia 170 indicating an area overlying the actuator which is to be pushed to hear a personally recorded message.

Referring also to FIG. 34, which is a plan view of the opposite side of messager 164 as shown in FIG. 33, there can be seen contacts 70 of electronic module 52 extending from the housing. Also shown is bottom sheet 10 with additional graphical written indicia printed thereon. According to this embodiment, which can be mass programmed (such as by gang programmer 72 shown in FIG. 13) or be self recorded by the user in a recording system as shown in FIG. 35 (as will be discussed below), batteries 76 are not to be installed until after recording is completed. For this reason, battery pack 172 is attached to bottom sheet 10, carrying batteries 76. Battery pack 172 includes tool 54*a* which may be inserted into opening 54 in order to withdraw electronic module 52 to the position shown in FIGS. 32 and 33. Battery pack 172 includes tab 174 which resiliently rests against electronic module 52 as it is withdrawn from the cavity of the housing. Tab 174 is shaped complementary to security slot 92 formed through electronic module 52 such that when the two are aligned, tab 174 engages slot 92, holding module 52 in the extended position shown in FIGS. 33 and 34.

Referring now to FIG. 35, which is a front elevation view of programmer 166 that may be used by a customer to program an individual and personal message into universal greeting messager 164. Programmer 166 has slot 176 into which messager 164 may be inserted. The engagement of tab 174 with slot 92 prevents electronic module 52 from sliding back into the housing of messager 164 when messager 164 is inserted into slot 176. Telephone handset 178 is provided for receiving the message to be recorded into messager 164. Push buttons 180 are provided for control, record, play and copy functions. Programmer 166 is provided with display 182 which indicates information relevant to recording the message, such as time remaining.

Programmer 166 may be located in any appropriate retail outlet where universal greeting messagers are available. After placing a personal message on messager 164, batteries 76 are inserted onto module 52, tab 174 is removed from engagement with slot 92 and module 52 is reinserted into the housing. Back sheet 10 may comprise two layers, the outer of which may be peeled off using tab 184 to expose an adhesive layer thereunder. Messager 164 may then be adhered to anything, such as a gift or a card.

Figure 36:
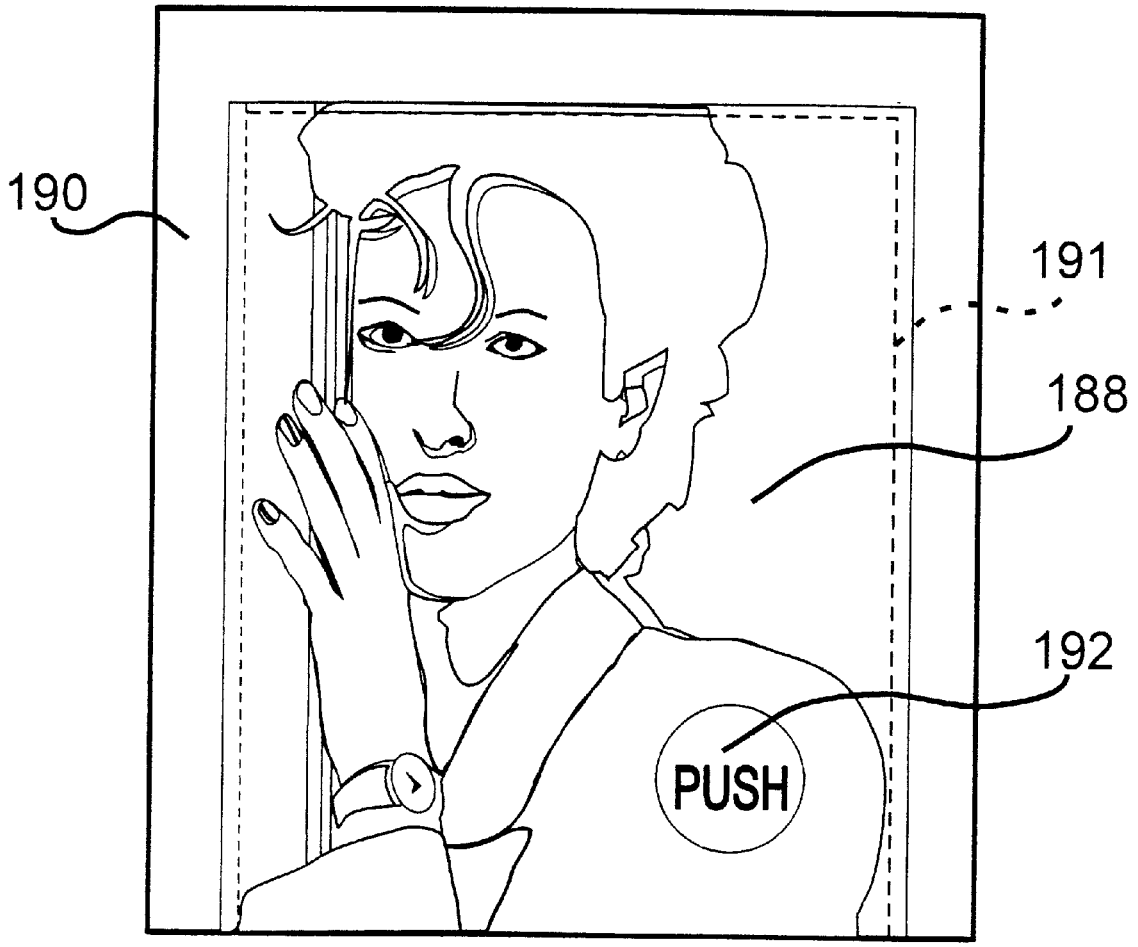
FIG. 36 is a front view of an alternate use of the communicating card of the present invention.

FIG. 36 is a front view of another use of a communicating card constructed in accordance with the present invention. In particular, FIG. 36 depicts a talking photograph 188. Housing 190 is glued to the back of photograph 188. Graphical/written indicia 192 may be added to photograph 188 to overlay the actuating mechanism for electronic module 52. A personalized message may be recorded onto module 52, in a manner similar to that described above with respect to universal greeting messager 164. Module 52 may then be inserted into a standardized cavity of an appropriately sized housing 190, which may be larger than photograph 188. In such case, photograph 188 may be cropped, as at dashed line 191, to the desired size, which may include cropping portions of housing 190 so long as module 52 is not affected. Thus, it is not necessary that it only be cut to standard sizes such as 4×6 or 8×10. The present invention accommodates the standardized sizes founded in conventional photo processing shops.

Figure 37:
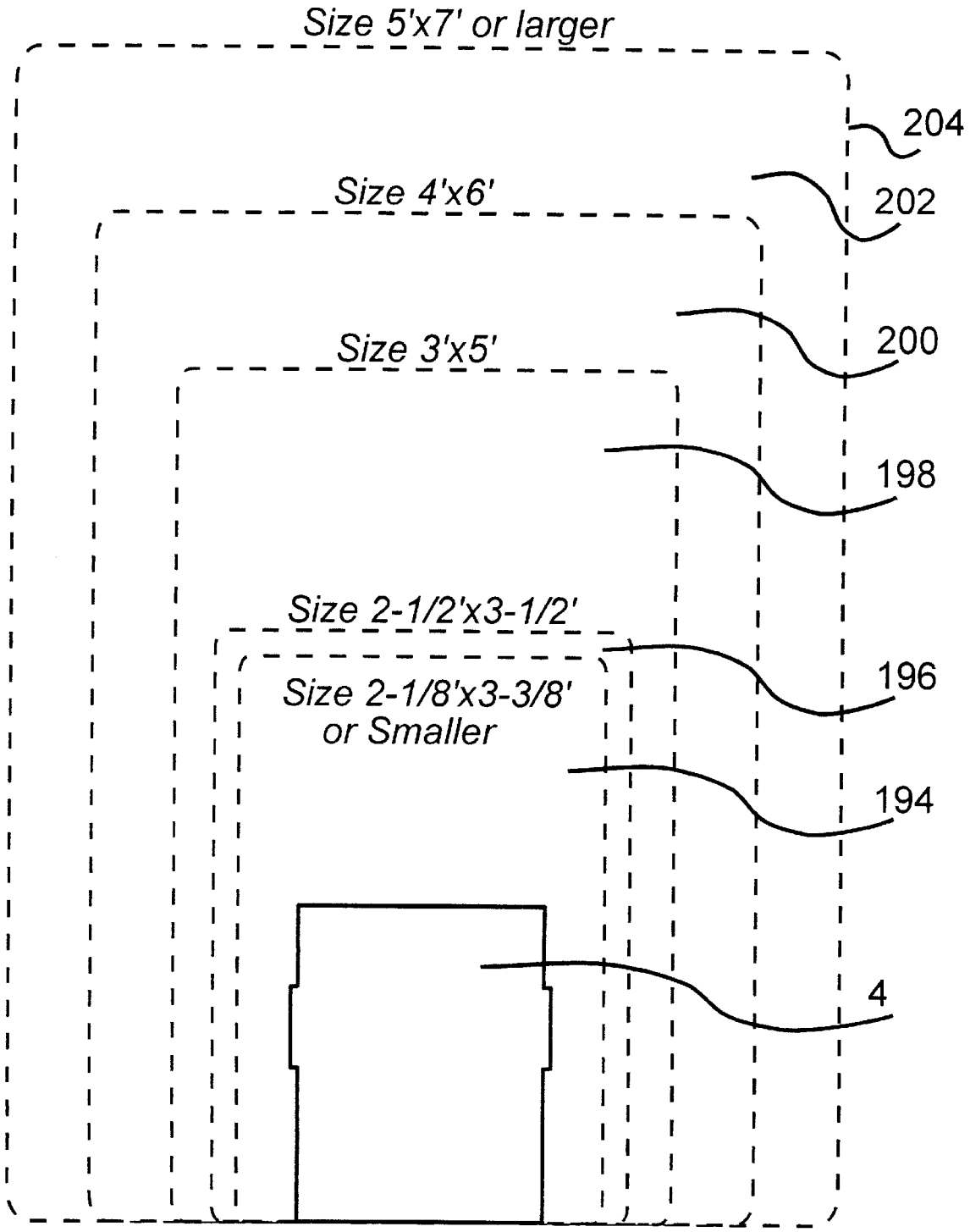
FIG. 37 is shown the use of a standard cavity in accordance with the principals and teachings of the present invention.

Referring now to FIG. 37, there is shown the use of a standard cavity 4 size for various sizes of housings 194, 196, 198, 200, 202 and 204. The various sizes of housings, which may begin as one large size which is cut down to match the application, can be used for a variety of applications based on the size, such as, for example, photo posters, counter displays, photographs, plaques, books, photo albums, autograph books, post cards, trading cards, entertainment cards, souvenir and memorial cards, business card, PCMCIA memory cards, smart cards, phone dialer cards, bank cards, telephone cards, universal greeting messagers, gift labels and bookmarks. Another application is celebrity stand-ups, in which an image of a celebrity, such as a sports figure, is used, and the housing may be cut to the outline of the celebrity's image. The stand-up could include its own folding stand attached to the rear of the housing.

Figure 38:
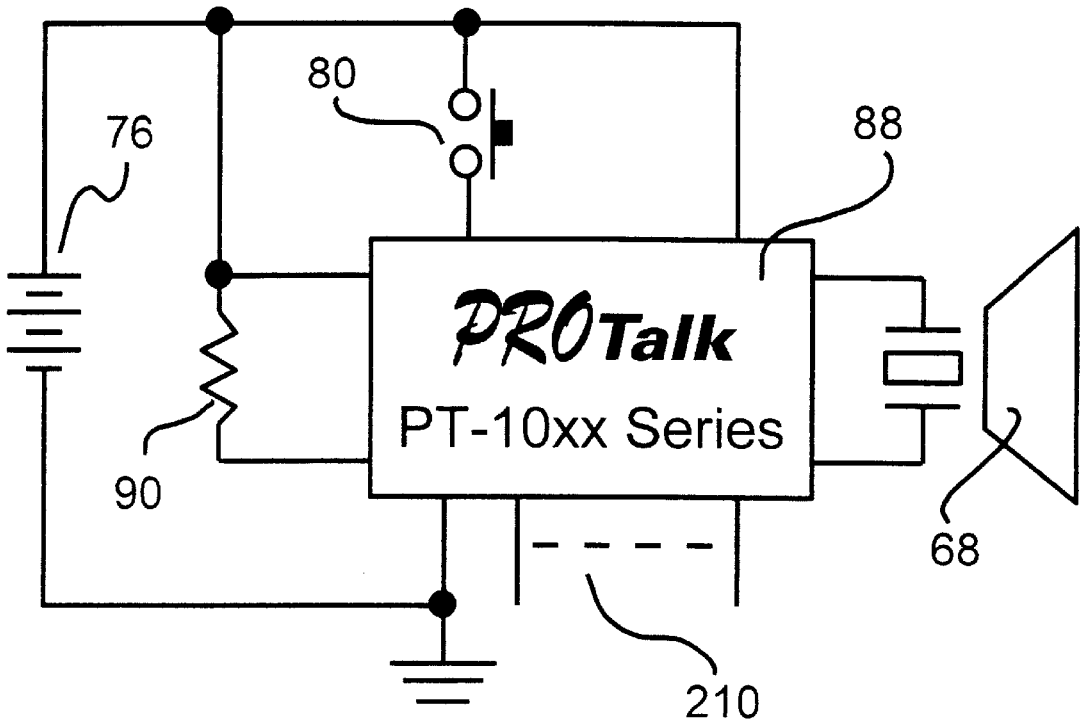
FIG. 38 is a schematic diagram illustrating the interconnections of various components.

FIG. 38 is a schematic diagram illustrating the interconnections of actuator 80, integrated circuit 88, resistor 90, batteries 76 and speaker 68. It will be appreciated that this is merely an illustrative circuit, and numerous other circuits are possible without deviating from the teachings of this invention. FIG. 38 includes a diagrammatic representation of interface 210, which may be used to connect integrated circuit 88 to a variety other devices. For example, interface 210 could be connected to a liquid crystal display to complement speaker 68. Interface 210 could be connected to a computer for verification of the originality of the card (such as with valuable collectable cards). Interface 210 could be connected to fingers 70 (see FIG. 10, for example).

In summary, numerous benefits have been described which result from employing the concepts of the invention. There has been described a communication card, many parts of which may be manufactured in parallel with each, providing extreme flexibility in inventory. The design allow high speed production without potential damage to the electronics. The design also allows low volume production to be done economically through the maximization of common, non application specific parts. The design allows communication cards to be manufactured with generally flat outer surfaces which provide some protection to the card housing against damage by individual components as well as resisting or preventing indentation of the housing.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A communicating card comprising:

an electronic module including electronic circuitry;

a communication interface coupled to said electronic circuitry, said electronic circuitry configured to deliver a communication through said communication interface in response to actuation of said electronic circuitry; and a housing defining an internal cavity, said cavity being configured to slidably receive said electronic module, said internal cavity including external opening through which at least a portion of said electronic module may be inserted so as to dispose at least a portion of said electronic module within said internal cavity wherein:

said electronic module comprise a plurality of layers; and said plurality of layers includes a first layer and a second layer disposed coplanar with each other, said first layer carrying electronic components, said second layer including a plurality of respective electronic components openings to accommodate the electronic components which extend from said first layer.

2. The communicating card of claim 1, wherein said plurality of layers includes a third layer disposed adjacent at least one of said first and second layers.

3. A communicating card comprising:

an electronic module including electronic circuitry;

a communication interface coupled to said electronic circuitry, said electronic circuitry configured to deliver a communication through said communication interface in response to actuation of said electronic circuitry;

a housing defining an internal cavity, said cavity being configured to slidably receive said electronic module, said internal cavity including an external opening through which at least a portion of said electronic module may be inserted so as to dispose at least a portion of said electronic module within said internal cavity wherein said electronic module comprise a plurality of layers; said plurality of layers includes a first layer and a second layer disposed adjacent each other, said second layer carrying said communication interface having a communication interface opening in which said communication interface is at least partially disposed, said communication interface comprises a speaker; and means for acoustically coupling said speaker with said housing and wherein said means includes a foam element.

4. The communicating card of claim 3, wherein said second layer includes a first surface surrounding said communication interface opening and said foam element includes a lip which extends beyond said electronic interface opening and is disposed adjacent at least a portion of said first surface.

5. A communicating card comprising:

an electronic module including electronic circuitry;

a communication interface coupled to said electronic circuitry, said electronic circuitry configured to deliver a communication through said communication interface in response to actuation of said electronic circuitry; and a housing defining an internal cavity, said cavity being configured to slidably receive said electronic module, said internal cavity including an external opening through which at least a portion of said electronic module may be inserted so as to dispose at least a portion of said electronic module within said internal cavity wherein:

said electronic circuitry includes a programmable memory configured to be programmed with a communication for delivery through said communication interface; and said electronic module includes at least one electrical contact for programming a communication into said programmable memory and is withdrawable from said internal cavity a sufficient distance to provide access to said at least one electrical contact whereby said programmable memory can be programmed.

6. A communicating card comprising:

an electronic module including electronic circuitry;

a communication interface coupled to said electronic circuitry, said electronic circuitry configured to delivery a communication through said communication interface in response to actuation of said electronic circuitry;

a housing defining an internal cavity, said cavity being configured to slidably receive said electronic module, said internal cavity including an external opening through which at least a portion of said electronic module may be inserted so as to dispose at least a portion of said electronic module within said internal cavity; and a resilient detent interengaged between said electronic module and said housing so that said electronic module can be inserted into said housing with resilient deflection of said detent, and said electronic module can be withdrawn from said housing only a predetermined distance which is limited by engagement of said detent.

7. The communicating card of claim 6, wherein said electronic module comprises an edge and elongated slot adjacent said edge, said detent being positioned on said edge, said detente being deflectable by resilient displacement of said edge adjacent said elongated slot.

8. The communicating card of claim 7, comprising an elongated recess within said internal cavity, said detent engaging said recess and inhibiting withdrawal of said electronic module from said housing when said detent reaches an end of said elongated recess closest to said external opening.

9. A communication card comprising:

an electronic module including electronic circuitry, a battery pack, and a communication interface coupled to said electronic circuitry, said electronic circuitry configured to deliver a communication through said communication interface in response to actuation of said electronic circuitry;

an enclosure configured to slidably mate with said electronic module wherein:

said enclosure defines an internal cavity, said internal cavity including an external opening through which at least a portion of said electronic module may be inserted so as to dispose at least a portion of said electronic module within said internal cavity; and said battery pack engaging said electronic module having at least one electrical contact disposed outside of said internal cavity, said battery pack being disengagable from said electronic module whereby said at least one electrical contact may thereafter be disposed at least partially in said internal cavity.

10. The communication card of claim 9, wherein said battery pack is removably carried by said card.

11. A communicating apparatus comprising:

an electronic module including:

electronic circuitry including electronic components;

a communication interface coupled to said electronic circuitry, said electronic circuitry configured to deliver a communication through said communication interface in response to actuation of said electronic circuitry; and a first layer and a second layer disposed coplanar with each other, said first layer carrying at least one of said electronic components, said second layer including said communication interface into which said at least one of said electronic components extend from said first layer; and a housing including a module cavity configured to mate with the electronic module.

12. The communicating card of claim 11, wherein said plurality of layers includes a third layer disposed adjacent at least one of said first and second layers.

13. The communicating card of claim 11, wherein said second layer includes a communication interface opening in which said communication interface is at least partially disposed.

14. The communicating card of claim 11, wherein said communication interface comprises a speaker.

15. The communicating card of claim 11, including a foam element which carries said communication interface.

16. The communicating card of claim 13, including a foam element which carries said communication interface and wherein said second layer includes a first surface surrounding said communication interface opening and said foam element includes a lip which extends beyond said electronic interface opening and is disposed adjacent at least a portion of said first surface.

17. The communicating card of claim 11, wherein said electronic circuitry includes a masked ROM which has been coded with a communication for delivery through said communication interface.

18. The communicating card of claim 11, wherein said electronic circuitry includes a programmable memory configured to be programmed with a communication for delivery through said communication interface.

19. The communicating card of claim 18, wherein said electronic module includes at least one electrical contact for programming a communication into said programmable memory.

20. The communicating card of claim 11, wherein said electronic module is covered by an outer layer.

21. The communicating card of claim 20, wherein said outer layer is adhered directly to said electronic module.

22. A communicating card comprising:

a communication module having a circuit layer and an output interface layer, said circuit layer includes electronic circuitry configured to generate electrical signals, said output interface layer includes a communication interface coupled to the electronic circuitry to generate an output, said output interface layer includes a left edge and a right edge wherein an elongated web protrudes from the left edge and the right edge; and a communication module housing having a cavity configured to slidably mate to the communication module wherein the two elongated webs engage respective detents within the cavity to prevent removal of the communication module.

23. The communicating card of claim 22, wherein said communication interface is a piezoelectric speaker.

* * * * *